US010577214B2

(12) United States Patent
Sudhir

(10) Patent No.: US 10,577,214 B2
(45) Date of Patent: Mar. 3, 2020

(54) PORTABLE AND DETACHABLE DISPENSER

(71) Applicant: Sanandan Sudhir, Delhi (IN)

(72) Inventor: Sanandan Sudhir, Delhi (IN)

( * ) Notice: Subject to any disclaimer, the term of this patent is extended or adjusted under 35 U.S.C. 154(b) by 244 days.

(21) Appl. No.: 15/599,837

(22) Filed: May 19, 2017

(65) Prior Publication Data

US 2017/0275126 A1 Sep. 28, 2017

Related U.S. Application Data

(63) Continuation-in-part of application No. 13/514,983, filed as application No. PCT/IN2010/000747 on Nov. 16, 2010, now Pat. No. 9,656,827.

(30) Foreign Application Priority Data

Dec. 11, 2009 (IN) ..... 2577/DEL/2009

(51) Int. Cl.
*B65H 35/00* (2006.01)
*B65H 23/08* (2006.01)
*B65H 35/06* (2006.01)

(52) U.S. Cl.
CPC ..... *B65H 35/002* (2013.01); *B65H 23/08* (2013.01); *B65H 35/008* (2013.01); *B65H 35/0026* (2013.01); *B65H 35/06* (2013.01)

(58) Field of Classification Search
CPC .. B65H 35/00; B65H 35/002; B65H 35/0026; B65H 35/0033; B65H 35/004
USPC ..... 225/10, 11, 12, 15
See application file for complete search history.

(56) References Cited

U.S. PATENT DOCUMENTS

| | | | | |
|---|---|---|---|---|
| 381,294 | A | 4/1888 | Tea | |
| 406,159 | A * | 7/1889 | Blaszkaye | 242/129.51 |
| 424,493 | A | 4/1890 | Morris | |
| 549,672 | A | 11/1895 | Jewell | |
| 673,778 | A * | 5/1901 | Merritt | B65H 75/406 242/395 |
| 1,296,117 | A | 3/1919 | Pierce et al. | |

(Continued)

OTHER PUBLICATIONS

USPTO Office Action dated Feb. 25, 2015 issued for parent U.S. Appl. No. 13/514,983.

(Continued)

*Primary Examiner* — Jason Daniel Prone
*Assistant Examiner* — Richard D Crosby, Jr.
(74) *Attorney, Agent, or Firm* — D'Ambrosio & Menon, PLLC; Usha Menon

(57) ABSTRACT

A lightweight, portable and detachable dispenser for reeled products such as tape, wrapping paper, aluminum foils and likes is disclosed. The dispenser includes a base portion that engages with inner circumference of a roll of the reeled product, and a top portion that is operatively coupled with the base portion and attaches to outer circumference of the roll, and includes a cutting means. The dispenser is made of a single wire, and allows dispensing of the reeled product in two different modes. In a first mode the reeled product is cut from top side and free end of the reeled product rests on a raised fourth portion of the top portion. In a second mode the reeled product is cut from bottom side and free end rests on a raised third portion of the top portion. Thus, the disclosed dispenser allows universal application and improves efficiency of dispensing.

19 Claims, 15 Drawing Sheets

(56) References Cited

U.S. PATENT DOCUMENTS 1,554,082 A * 9/1925 Gerould ..... A47F 13/04 242/129.6
2,049,086 A * 7/1936 Shingleton ..... B65H 75/40 191/12.2 R
2,401,286 A * 5/1946 Wright ..... B65H 35/008 206/54
2,588,043 A 3/1952 Rabinowitz et al.
2,655,214 A 10/1953 Van Cleef
2,703,208 A 3/1955 Tasker
2,704,190 A * 3/1955 Schmale ..... B65H 75/40 242/396.6
2,706,003 A 4/1955 Isler
2,734,575 A * 2/1956 Gilbreth et al. ... B65H 35/0026 225/56
2,788,181 A * 4/1957 Anderson ..... B65H 35/0026 225/65
D182,792 S * 5/1958 Cullen ..... D19/69
D182,793 S * 5/1958 Cullen ..... D19/69
3,086,723 A * 4/1963 Meeks ..... B65H 35/0026 242/588
3,134,526 A * 5/1964 Schleicher ..... B65H 35/0026 225/33
3,149,764 A 9/1964 Waltz
3,176,892 A * 4/1965 Waltz ..... B65H 35/0026 15/230.11
3,217,955 A * 11/1965 Tinkey ..... B65H 35/002 225/47
3,283,977 A 11/1966 Schluchter
3,378,184 A 4/1968 Mallory
3,556,367 A 1/1971 Ikeda
3,589,634 A * 6/1971 Mason ..... B65H 16/005 242/422.4
3,684,141 A * 8/1972 Hall ..... B65H 35/002 225/65
3,693,853 A * 9/1972 Siegal ..... B65H 35/002 225/58
3,696,980 A 10/1972 Waltz
3,968,915 A * 7/1976 Schleicher ..... B65H 35/0026 225/65
4,088,276 A * 5/1978 Littleton ..... B65H 16/005 225/46
4,093,138 A 6/1978 Shafer
4,194,658 A 3/1980 Tschudin
4,225,071 A * 9/1980 Laviano ..... B65H 35/008 225/65
4,321,755 A * 3/1982 Illgen ..... G01C 15/10 224/269
4,405,068 A * 9/1983 Blair ..... B65H 35/0026 225/65
4,496,276 A * 1/1985 Shulyak ..... B65H 35/008 225/58
4,606,485 A 8/1986 Rankin
4,667,891 A 5/1987 Pool
4,711,384 A * 12/1987 Harris ..... B65H 35/0026 225/66
D308,891 S 6/1990 Harris
D310,103 S * 8/1990 Beirise ..... D19/67
4,957,234 A * 9/1990 Orlandini ..... B65H 35/008 225/56
4,961,525 A * 10/1990 Corbo ..... B65H 35/0026 225/56
D317,984 S * 7/1991 Reynoso ..... D19/67
5,071,051 A * 12/1991 Corbo ..... B65H 35/0026 225/56
5,238,201 A * 8/1993 Jonushaitis ..... B65H 75/406 242/396.8
5,551,646 A 9/1996 Goldstein
5,636,809 A 6/1997 Koch
5,706,993 A 1/1998 Dematteis
5,759,342 A 6/1998 Luhman et al.
5,775,624 A 7/1998 Huerta
5,788,807 A 8/1998 Gratz
5,868,893 A 2/1999 Kipper et al.
5,934,535 A 8/1999 Kannankeril et al.
6,095,455 A * 8/2000 Green ..... A45F 5/02 24/3.12
6,216,978 B1 * 4/2001 Rodriguez ..... E04F 21/00 242/588.1
6,257,298 B1 7/2001 Huang
6,279,806 B1 8/2001 Simhaee
6,561,403 B1 * 5/2003 Kannankeril ..... A47F 13/085 225/106
6,648,265 B2 11/2003 Goldberg
6,695,190 B1 * 2/2004 Gunter, Jr. ..... B65H 35/002 156/527
7,014,081 B2 * 3/2006 Ortin ..... B65H 35/0026 225/65
7,096,915 B2 * 8/2006 Yu Chen ..... B65H 16/02 156/577
7,210,650 B2 * 5/2007 Metzger ..... B65H 35/0033 225/39
7,387,275 B1 6/2008 Hui
7,841,498 B1 11/2010 Rohrer
7,861,904 B1 * 1/2011 Taylor ..... B65H 35/0026 225/65
8,443,862 B1 5/2013 Manabat
8,839,838 B2 * 9/2014 Parkhe ..... B65H 35/0026 156/527
8,991,674 B2 3/2015 Lee
10,221,036 B2 * 3/2019 Temblador ..... B65H 75/24
10,266,366 B2 * 4/2019 Galindo Gonzalez ..... B65H 75/241
2002/0170937 A1 * 11/2002 Yeh ..... B65D 33/002 225/39
2002/0185512 A1 * 12/2002 Shah ..... B65H 35/0026 225/56
2004/0011473 A1 * 1/2004 Van Tyle ..... B65H 35/0033 156/527
2006/0076384 A1 * 4/2006 Dickie ..... B65H 35/0026 225/39
2006/0219748 A1 10/2006 Thompson et al.
2007/0210131 A1 * 9/2007 Yarborough ..... B65H 49/205 225/56
2007/0235494 A1 * 10/2007 Foran ..... B65H 35/0026 225/39
2007/0246153 A1 * 10/2007 Schurman ..... B29C 63/10 156/185
2008/0041908 A1 * 2/2008 Daniels ..... A47F 9/042 225/93
2008/0135181 A1 6/2008 Lee
2009/0008422 A1 * 1/2009 Daniels ..... B26F 3/02 225/46
2009/0302084 A1 12/2009 Liu
2010/0193539 A1 8/2010 Fathi
2011/0073629 A1 * 3/2011 Tseng ..... B26F 3/02 225/51
2012/0305619 A1 * 12/2012 Tan ..... B26F 3/02 225/106
2013/0048775 A1 * 2/2013 Sudhir ..... B65H 35/0026 242/557
2013/0306697 A1 * 11/2013 Lee ..... B65H 35/0033 225/65
2014/0048576 A1 * 2/2014 Tan ..... B65H 35/10 225/51
2014/0144966 A1 * 5/2014 Tan ..... B26F 3/02 225/47
2014/0209651 A1 * 7/2014 Wilfong ..... A47F 13/085 225/93
2015/0321867 A1 * 11/2015 Johnson ..... B65H 35/0026 225/1
2017/0275126 A1 * 9/2017 Sudhir ..... B65H 35/0026
2018/0354740 A1 * 12/2018 Elliott ..... B65H 35/002

OTHER PUBLICATIONS

USPTO Office Action dated Jun. 18, 2015 issued for parent U.S. Appl. No. 13/514,983.
USPTO Office Action dated Oct. 6, 2015 issued for parent U.S. Appl. No. 13/514,983.

(56) References Cited

OTHER PUBLICATIONS

USPTO Office Action dated Sep. 10, 2014 issued for parent U.S. Appl. No. 13/514,983.
USPTO Office Action dated Feb. 25, 2016 issued for parent U.S. Appl. No. 13/514,983.
USPTO Final Office Action dated Sep. 9, 2016 issued for parent U.S. Appl. No. 13/514,983.

* cited by examiner

PORTABLE AND DETACHABLE DISPENSER

CROSS REFERENCE TO RELATED APPLICATIONS

This application is a continuation-in-part of and claims priority to U.S. Ser. No. 13/514,983 filed Oct. 26, 2012, which is a U.S. National Stage filing under 35 U.S.C. 371 of PCT application number PCT/IN2010/000747 filed on Nov. 16, 2010, claiming benefit of Indian application no. 2577/DEL/2009, filed Dec. 11, 2009, the contents of which are incorporated by reference herein.

TECHNICAL FIELD

The present disclosure relates to the field of dispensers for reeled products. In particular, it pertains to a portable and detachable dispenser for reeled products such as tape, wrapping paper, aluminum foils and likes. Specifically, the disclosed dispenser incorporates structural features to keep it in a secured position on the reeled product even with a diminishing size of roll of the reeled product and allow small specific lengths to be cut as well as allow larger lengths to be cut for bulk packaging using the same reeled product.

BACKGROUND OF THE INVENTION

Background description includes information that may be useful in understanding the present invention. It is not an admission that any of the information provided herein is prior art or relevant to the presently claimed invention, or that any publication specifically or implicitly referenced is prior art.

Reeled products such as adhesive tapes, aluminum foils, and toilet papers, pose a unique trouble while they are dispensed from their roll. By virtue of being packed in a rolled manner, dispensing them becomes a tedious task as far as locating the ends or tearing them for customized use is concerned. Typical dispensers such as tape dispensers address this issue by having a cutting edge that facilitates tearing of the tape at the desired length. Even though, this arrangement is convenient, many of such dispensers do not have the facility to prevent spontaneous reattachment of the tape end back to the reel whereby re-locating the end is often difficult.

Typically, there are two types of dispensers, namely small dispensers for cutting a small measure of the tape like the desktop and table top dispensers, in which user holds the glue side of the tape, pulls it, and cuts using the fixed edge. Second type being used for bulky dispensers that are used to do carton boxes where the blade cuts the tape from the non-glue side.

These dispensers are further heavy or bulky, being much larger than the roll they accommodate. These devices are mostly designed as table top devices. Attempts have been made to provide a dispenser for holding a reel so that it is easy to tear the reel and still retain its end separated from the roll. These attempts were not highly successful particularly because such an arrangement would have required different dispensers for each size of the reel.

Use of clip dispensers has largely negated the bulkiness aspect associated with traditional dispensers, but the problem with a typical clip dispenser is that they cannot provide constant and positive holding three with the decreasing thickness of the reel layers. It is further noticed that when the size of the reel is minimum the clips of the dispenser runs the risk of being released from the crust of the reel. It is further noticed that such dispensers will tear and deform the edges of the sides of the reel while the dispenser slides through the reel.

U.S. Pat. No. 4,496,276 discloses a compact tape shear, which is a plastic material that is transversely strapped around the tape roll and its core. The shear comprises a locking tongue and a cutting edge. However, the holding force provided by the shear of the '276 patent decreases with the decreasing thickness of tape layers, resulting in loss of stability. This eventually translates into an ineffective functioning of cutting edge and hence the shear.

U.S. Pat. No. 5,634,580 disclose a tape dispenser which is held in position by engaging the sides of the tape roll only. The '580 patent specifically discloses a dispenser having two flank sections located on either sides and these flanks are clipped onto the reeled tape in a radial direction. However, the '580 patent does not provide answers to the issues of loosing the holding forces with decreasing the thickness of the reel. The design of the dispenser of the '580 patent also pose a risk of the dispenser getting detached from the tape while tearing the tape.

U.S. Pat. No. 6,561,403 discloses a bag dispenser, for separating and dispensing plastic bags where one end of the plastic bag is attached to top of the next bag by perforation lines. The dispenser comprising a wire frame formed into arcuate channels to support core that the series of bags are rolled onto. The dispenser includes a second tensioning member attached to a support member and disposed at an angle thereto to provide tension to the edges of the roll of bags as the core passes through the channel passageway as bags are removed from the roll. Spaced apart from the support is a symmetric separating tongue. The dispenser of '403 does not have any cutting means as the bags are attached to next bag by a perforated lines, and therefore cannot be universally used for all reeled products.

U.S. Patent number US20080135181 an adhesive tape dispenser with improved cutting operation of the adhesive tape at a lower part of a case body. The adhesive tape dispenser includes a case body having a body case formed with a holding part to mount an adhesive tape inside, a coupling case coupled with the body case and formed with an assembling space at a rear part, and a cover case formed with a fitting piece at a front part to be coupled in the assembling space. The case body is formed with a mounting hole at a front part and an exposure space at an upper part of the mounting hole. A cutter part is mounted in a mounting hole of the case body. An elastic pressing plate is positioned at an upper part of the holding part for pressing the adhesive tape downward elastically to keep tension when the adhesive tape is released. The dispenser of '181 suffers from drawback of too many parts and complicated construction.

U.S. Patent Application number US2010/0193539 discloses a dispenser for length material, the dispenser comprises a first resiliently biased locking roller and a second locking roller defining a nip there between for the passage of length material to be dispensed, the second roller being carried on a frame which upon appropriate movement causes the second roller to move into a locking position in relation to the first locking roller to clamp the length material to prevent unreeling or return of the free end thereto once appropriate cutting of a portion of the length material has been effected. The dispenser of '539 also suffers from drawback of too many parts and complicated construction.

U.S. Pat. No. 3,684,141 discloses a tape dispensing device formed as a unitary body includes a central dispensing portion with a slot through which tape is withdrawn and wing members integrally connected to opposite sides of the dispensing member and arranged to fold along opposite sides of a roll of tape material to form a saddle-like arrangement; a retainer holds the dispensing member against the outer surface of the roll, and a cutter member formed as an integral part of the dispenser can be moved, as through the use of the thumb and index finger of one hand, into operative position for severing a length of tape while leaving a portion of the tape remaining on the roll extending through the slot for easy grasping when the next length of tape is to be withdrawn. The tape dispensing device of '141 suffers from drawback that it cannot automatically adjust for reducing thickness of roll of tape and has to be manually adjusted to prevent looseness of the dispenser over the roll of the tape.

Great Britain Patent number GB771834 discloses a tape dispenser mounted on a coil of tape so as to be free to slide relatively around the coil, comprises a part adapted to bear on the outer periphery of the coil and another part adapted to bear on the inner periphery, the two parts being resiliently interconnected, e.g. by wire arms, and being arranged so that the dispenser will be maintained in firm contact with the coil at all times as the diameter of the coil is reduced, and a severing blade carried by the first mentioned part. The tape dispenser of '834 suffers from drawback that insertion of roll of tape would require considerable effort and time.

Australian Patent number AU1786367 discloses an adhesive tape dispenser comprising two leg sections joined at one end by a body section to form a generally U-shaped member adapted to straddle a tape roll, the other end of each leg having means for slidable attachment to the tape reel on which the roll is wound, the body section comprising a cutting edge and a tape holding member over which the tape is drawn during the cutting action. The tape holding member comprises a shoulder spaced from the cutting edge and to which the end of the tape on the roll is stuck after the cutting action. The adhesive tape dispenser of '367 suffers from drawback that it cannot automatically adjust for reducing thickness of roll of tape and has to be manually adjusted to prevent looseness of the dispenser over the roll of the tape.

The portable dispensers of the existing art though addressed the issue of size and weight but suffer from one or other drawback. Specifically, none of them has flexibility to dispense the reeled product in different configurations to enable cutting of the reeled product from either side i.e. from bottom side or top side so as to enable universal application.

It is, therefore, a need in the art to create a portable and detachable dispenser that has flexibility to dispense the reeled product in different configurations to enable cutting of the reeled product from either side i.e. from bottom side or top side so as to enable universal application, apart from providing a uniform cutting and reel locating means, a constant and positive holding force at all stages and all thicknesses of the reel. A dispenser of such a nature must not be dislodged at any instance unless specifically pulled out of the reel. Further, such a dispenser must be light weight and convenient to use to make it suitable for use by children and disabled persons. It would be further advantageous if the dispenser could also brand the dispensed reeled product at time of dispensing according to need of its user.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

OBJECTS OF THE INVENTION

It is an object of the present disclosure to provide a portable and detachable dispenser for reeled products.

It is an object of the disclosure to provide a compact, portable, and easy-to-use dispenser for reeled products.

It is an object of the disclosure to provide a dispenser that is of simple construction and light weight.

It is an object of the disclosure to provide a dispenser that continues to provide constant and uniform holding force to keep the dispenser on the roll even with diminishing diameter of the roll.

It is another object of the disclosure to provide a stable dispenser that does not fall off the roll at any stage of use.

It is an object of the disclosure to provide a dispenser that allows dispensing of reeled product in two different modes for universal application while dispensing the reeled product.

It is an object of the disclosure to provide a dispenser that enables branding of dispensed reeled product by self-inking action.

It is an object of the disclosure to provide a dispenser that allows dispensing of reeled product by holding the dispenser and the reeled product in hand and moving around large objects that cannot be moved.

It is an object of the disclosure to provide a dispenser that allows rewinding of excess length of reeled product back to roll of the reeled product.

It is an object of the disclosure to provide a dispenser having slidable movement of the reeled product during its working.

It is an object of the disclosure to provide a dispenser that enables easy relocation of a cut end of the reeled product.

SUMMARY

Aspects of the present disclosure relate to a portable and detachable dispenser for reeled products such as tape, wrapping paper, tissue paper, aluminum foils and likes.

In an aspect, the dispenser of the present disclosure comprises a base portion that is directly or indirectly lodged along inner circumference part of roll of the reeled product and provides an anchoring support to the dispenser; and a top portion that essentially lies over and in contact with outer circumference of the roll to allow the free end of the reeled product to pass through it and rest on a raised area which comprises of a cutting means.

In an aspect, top portion of the disclosed dispenser is operatively coupled with base portion through a first major flanking portion such that the top portion remains biased towards the base portion; the biasing force thus provides a continuing contact of the top portion with outer circumference of the reeled product even as thickness of roll of the reeled product gets diminished with usage.

In an aspect, top portion comprises a first portion to which a cutting means are detachably fixed, a second portion and a raised third portion positioned on one side of the first portion, and a raised fourth portion positioned on the other side of the first portion.

In an aspect, configuration of top portion of the disclosed dispenser allows reeled product to be dispensed in two different modes, wherein in a first mode, the reeled product passes under the second portion, the raised third portion, and the first portion to enable the reeled product to be cut from bottom side using cutting means attached to the first portion and the free end of the reeled product rests on the raised fourth portion.

In an aspect, in a second mode, the reeled product passes under second portion and over raised third portion to enable the reeled product to be cut from top side using the cutting means attached to the first portion, and the free end of the reeled product rests on the raised third portion.

In an aspect, a roller is configured on the second portion to enable free passing and smooth sliding of the reeled product through top portion as the reeled product is pulled for dispensing. In an embodiment, the roller can be a self-inking roller that marks a logo, a tag line or a symbol for branding of the reeled product as the reeled product is being dispensed.

In an aspect, top portion further incorporates an inclined portion extending vertically down from a fifth horizontal portion on the same side as first major flanking portion that connects the top portion to the bottom portion.

In an aspect, the top portion and base portion of the disclosed dispenser is made of a single wire of a material that has spring property to keep top portion and base portion biased towards each other.

In an aspect, cutting means disposed on first portion of the top portion comprise a horizontally disposed first cutting edge and a vertically disposed second cutting edge, and wherein the first cutting edge is used to cut the reeled product from top side of the reeled product in the first mode of dispensing the reeled product; and the second cutting edge is used to cut the reeled product from bottom side of the reeled product in the second mode of dispensing the reeled product. In another aspect, the first cutting edge and the second cutting edge are tapered in their respective planes in relation with axis of the reeled product. In an exemplary aspect, the first cutting edge can be functional for thinner tapes, and the second cutting edge can be more functional for cutting thicker tapes.

In an embodiment, the horizontally disposed first cutting edge and the vertically disposed second cutting edge are configured on an V shaped blade held in a blade holder, and wherein the blade holder is configured for fitment on first portion of the top portion to form the cutting means. In an embodiment, the first cutting edge and the second cutting edge incorporate a plurality of V shaped notches along their length.

In an alternate implementation, horizontally disposed first cutting edge and the vertically disposed second cutting edge are formed of a plurality of quadrants fixed parallel to each other on a holder, wherein corners between the horizontal sides and circular sides of the plurality of quadrants form the first cutting edge, and corners between the vertical sides and the circular sides of the plurality of quadrants form the second cutting edge. In an embodiment, the circular side of the plurality of quadrants is made pointed to provide sharp and pointed corners.

In an aspect, circular cross section of wire used to form base portion can be pressed into rectangular cross section.

In another alternate implementation, cutting means is formed on two parallel horizontally disposed portions of first portion, wherein the two horizontally disposed portions incorporate vertically oriented V shaped teeth and horizontally oriented V shaped teeth respectively to provide the first cutting edge and the second cutting edge.

In an aspect, the disclosed dispenser is operatively coupled with a cassette that holds a roll of a reeled product through inner circumference of the reeled product. The cassette comprises a first side cover and a second side cover wherein the first side cover and the second side cover are inserted from opposite sides of the reeled product and engage with each other to hold the reeled product between them such that the reeled product is free to rotate relative to the cassette. In an aspect, the first side cover and the second side cover engage with each other through a set of at least three equispaced pairs of snap grooves and snaps on the first side cover and the second side cover respectively.

In an aspect, first side cover incorporates a right side flange and the second side cover incorporates a left side flange to cover sides of reeled product from the two sides, and both the right side flange the left side flange have top side cut out in matching positions to allow operative coupling of the disclosed dispenser with the reeled product held between the first side cover and the second side cover.

In an aspect, when the disclosed dispenser is coupled with the reeled product held between the first side cover and the second side cover, the base portion of the dispenser engages with inner circumference of the first side cover and the second side cover thus leading to an indirect lodging of the dispenser along inner circumference part of roll of the reeled product. In an aspect, inner circumference of any or both of the first side cover and the second side cover incorporates means to engage with the base portion to keep the dispenser in position.

The proposed design allows the product to be used in both orientations i.e. for cutting small pieces of tape for table top use as well as for bulk usage to seal cartons.

It should be appreciated that the cutting portion can be integral on the wire itself (the wire being flattened and then the teeth stamped/formed on to the same), making the cutting portion integral as well as detachably fixed.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION

Figure 1B:
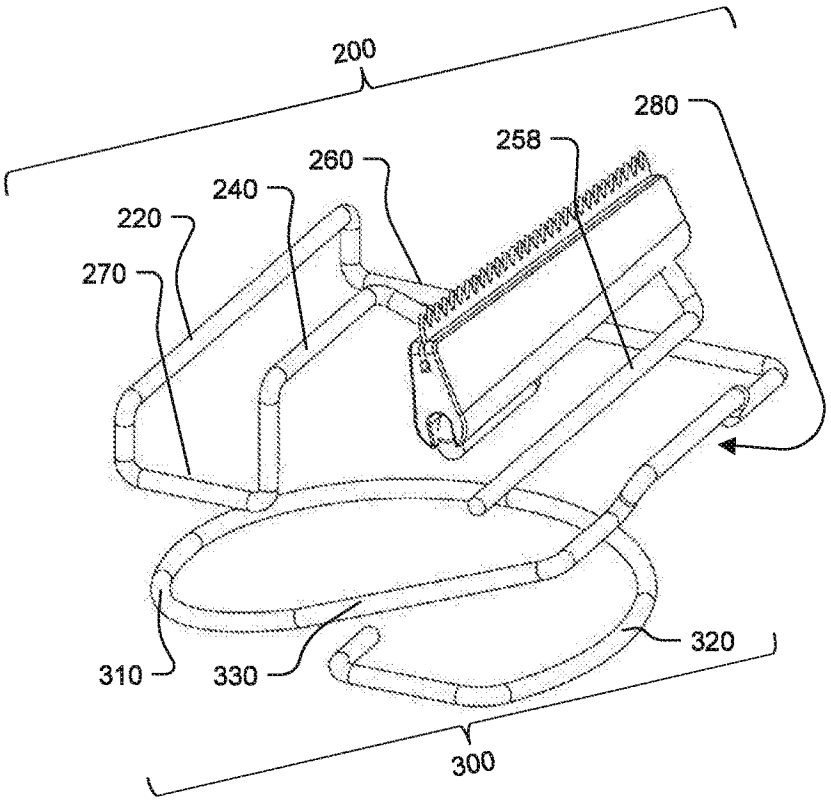
FIGS. 1A to 1D illustrate exemplary representation of top portion and bottom portion of the disclosed reeled product dispenser in accordance with embodiments of the present disclosure.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims.

Various terms as used herein. To the extent a term used in a claim is not defined, it should be given the broadest definition persons in the pertinent art have given that term as reflected in printed publications and issued patents at the time of filing.

Aspects of the present disclosure relate to a lightweight, portable and detachable dispenser for reeled products that comprises a base portion, and a top portion operatively coupled to the base portion such that the base portion and the top portion are biased towards each other. In an aspect, the base portion and the top portion are made of a single wire.

During application, the base portion is lodged along inner circumference part of roll of a reeled product and provides an anchoring support to the dispenser. Top portion essentially lies over and in contact with outer circumference of the roll to allow the free end of the reeled product to pass through it and rest on a raised area. Further, a cutting means is operatively coupled to the top portion to facilitate cutting of the dispensed reeled product.

In an aspect, top portion comprises a first portion to which a cutting means are affixed, a second portion and a raised third portion positioned on one side of the first portion, and a raised fourth portion positioned on the other side of the first portion.

In an aspect, base portion comprises a bottom curved wire portion 01 and a bottom curved wire portion 02, the two bottom curved wire portion connected to each other by a bottom curve wire; and a first major flanking portion. The bottom curve wire portion 02 passes underneath the roll, crossing the breadth of the inner circumference of the roll and curves in a circular fashion to form the first major flanking portion which takes a vertical slanting orientation. The first major flanking portion joins fourth portion of the top portion for operative coupling of the top portion and the base portion.

In an aspect, first major flanking portion gets disposed on one side of the reeled product, and the top portion includes a second major flanking portion that gets disposed on the other side of the reeled product so that the dispenser is secured with the reeled product without any chance of slipping out. The second major flanking portion extends from fourth portion to second portion of the top portion.

In an aspect, configuration of top portion of the disclosed dispenser allows reeled product to be dispensed in two different modes, wherein in a first mode, the reeled product passes under the second portion, the raised third portion, and the first portion to enable the reeled product to be cut from top side using cutting means attached to the first portion, and the free end of the reeled product rests on the raised fourth portion.

It is to be appreciated that ability to configure dispensing of a reeled product such as an adhesive tape in manner as in first mode wherein the tape gets cut from top that is non-adhesive side, enables keeping the tape close to an object on which the tape is being cut after being dispensed.

This provides an advantage during dispensing of the tape around an object as no separate manual effort to hold the cut end and thereafter pasting/sticking it to surface of the object would be required as the tape can be cut close to the surface.

In an aspect, in a second mode, the reeled product passes under second portion and over raised third portion to enable the reeled product to be cut from bottom side using the cutting means attached to the first portion, and the free end of the reeled product rests on the raised third portion.

In an aspect, top portion and base portion of the dispenser are made of a single wire of a material that has spring property to keep top portion and base portion biased towards each other. The biasing force thus provides a continuing contact of the top portion with outer circumference of the reeled product even as thickness of roll of the reeled product gets diminished with usage.

In an aspect, a roller is configured on the second portion to enable free passing and smooth sliding of the reeled product through top portion as the reeled product is pulled for dispensing.

In an aspect, top portion further incorporates an inclined portion extending vertically down from a fifth horizontal portion on the same side as first major flanking portion that connects the top portion to the bottom portion.

In an aspect, cutting means disposed on first portion of the top portion comprise a horizontally oriented first cutting edge and a vertically oriented second cutting edge, and wherein the first cutting edge is used to cut the reeled product from top side of the reeled product in the first mode of dispensing the reeled product; and the second cutting edge is used to cut the reeled product from bottom side of the reeled product in the second mode of dispensing the reeled product. In another aspect, the first cutting edge and the second cutting edge are tapered in their respective planes in relation with axis of the reeled product.

In an embodiment, the horizontally disposed first cutting edge and the vertically disposed second cutting edge are configured on an V shaped blade held in a blade holder, and wherein the blade holder is configured for fitment on first portion of the top portion to form the cutting means. In an embodiment, the first cutting edge and the second cutting edge incorporate a plurality of V shaped notches along their length.

In an alternate implementation, horizontally oriented first cutting edge and the vertically oriented second cutting edge are formed of a plurality of quadrants fixed parallel to each other on a holder, wherein corners between the horizontal sides and circular sides of the plurality of quadrants form the first cutting edge, and corners between the vertical sides and the circular sides of the plurality of quadrants form the second cutting edge. In an embodiment, the circular side of the plurality of quadrants is made pointed to provide sharp and pointed corners.

In another alternate implementation, cutting means is formed on two parallel horizontally disposed portions of first portion, wherein the two horizontally disposed portions incorporate vertically oriented V shaped teeth and horizontally oriented V shaped teeth respectively to provide the first cutting edge and the second cutting edge.

In an aspect, the disclosed dispenser is operatively coupled with a cassette that holds a roll of a reeled product through inner circumference of the reeled product. The cassette comprises a first side cover and a second side cover wherein the first side cover and the second side cover are inserted from opposite sides of the reeled product and engage with each other to hold the reeled product between them such that the reeled product is free to rotate relative to the cassette. In an aspect, the first side cover and the second side cover engage with each other through a set of at least three equispaced pairs of snap grooves and snaps on the first side cover and the second side cover respectively.

In an aspect, first side cover incorporates a right side flange and the second side cover incorporates a left side flange to cover sides of reeled product from the two sides, and both the right side flange the left side flange have top side cutouts in matching positions to allow operative coupling of the disclosed dispenser with the reeled product held between the first side cover and the second side cover.

In an aspect, when the disclosed dispenser is coupled with the reeled product held between the first side cover and the second side cover, the base portion of the dispenser engages with inner circumference of the first side cover and the second side cover thus leading to an indirect lodging of the dispenser along inner circumference part of roll of the reeled product. In an aspect, inner circumference of any or both of the first side cover and the second side cover incorporates means to engage with the base portion to keep the dispenser in position. In an aspect, the proposed tape dispenser can be used without side covers in order to cut tape from top side (non-glue side) as mentioned in the second mode.

FIGS. 1A to 1D illustrate exemplary representations of the disclosed reeled product dispenser 100 wherein the reeled product dispenser 100 consists of a top portion 200 and a base portion 300 wherein the top portion 200 is configured to attach to outer circumference of the reeled product 400. As shown, the top portion 200 comprises a first portion 250 to which a cutting means 248 is operatively coupled, a second portion 220 and a raised third portion 230 positioned on one side of the first portion 250, and a raised fourth portion 280 positioned on the other side of the first portion 250.

Figure 1A:
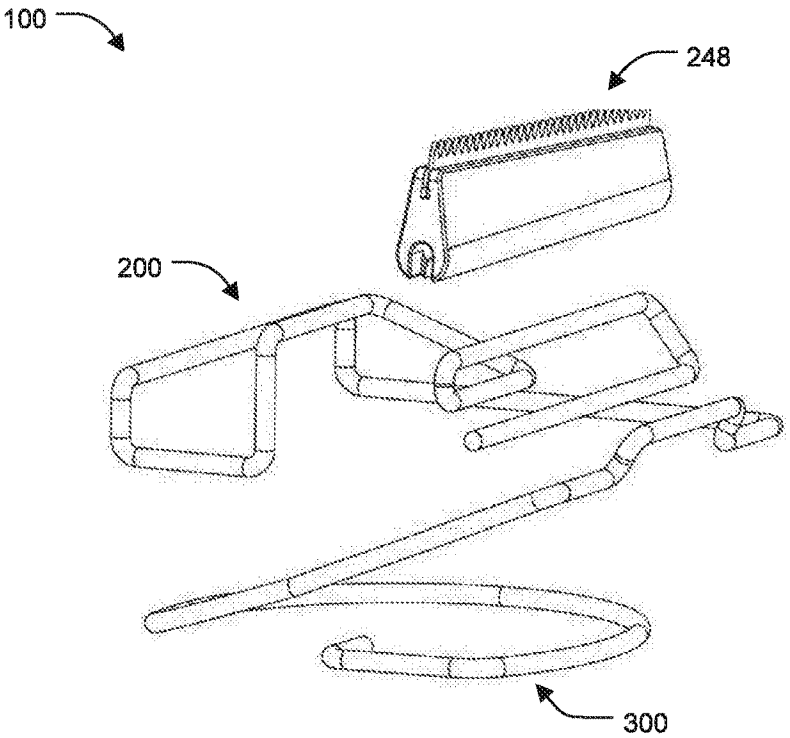
Figure 1C:
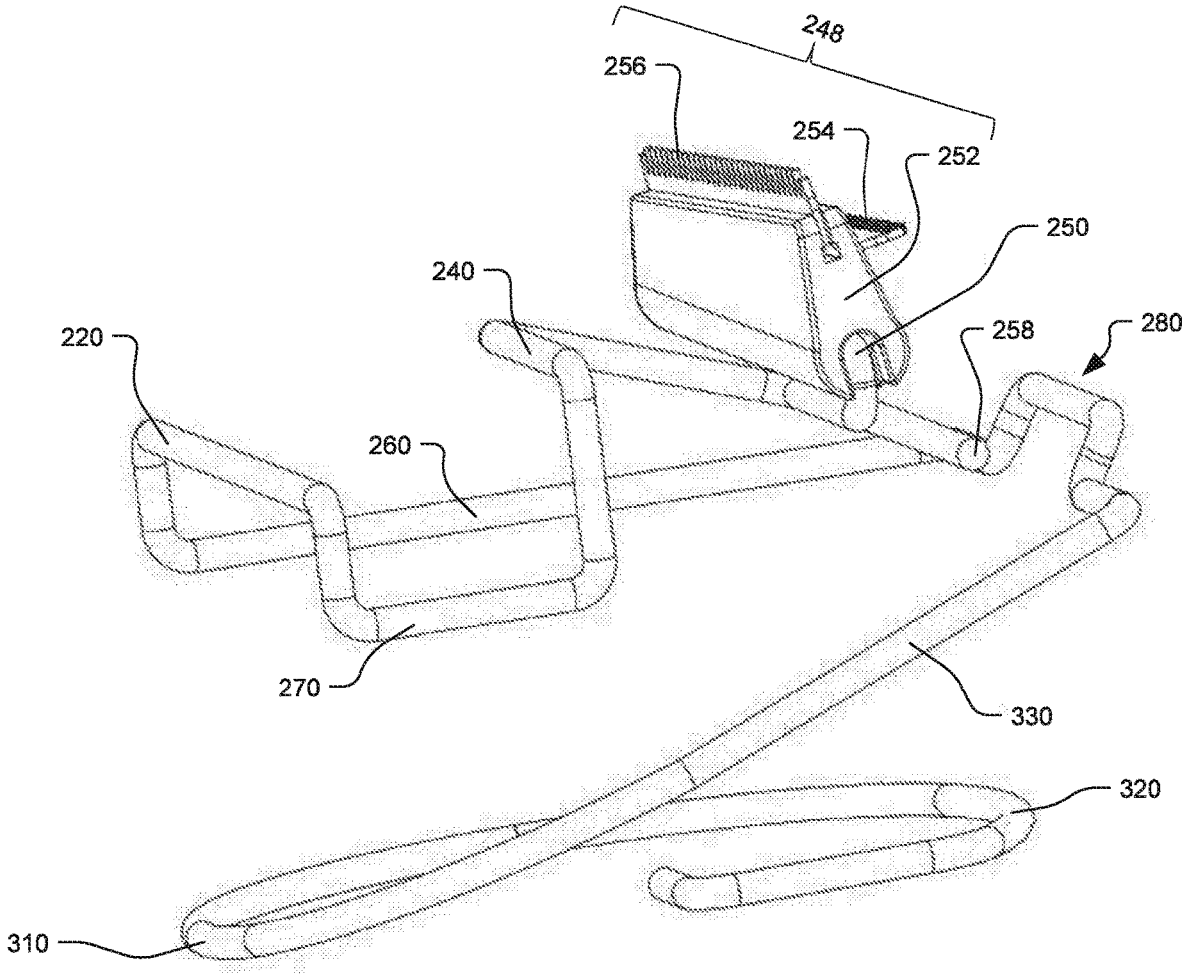
Figure 1D:
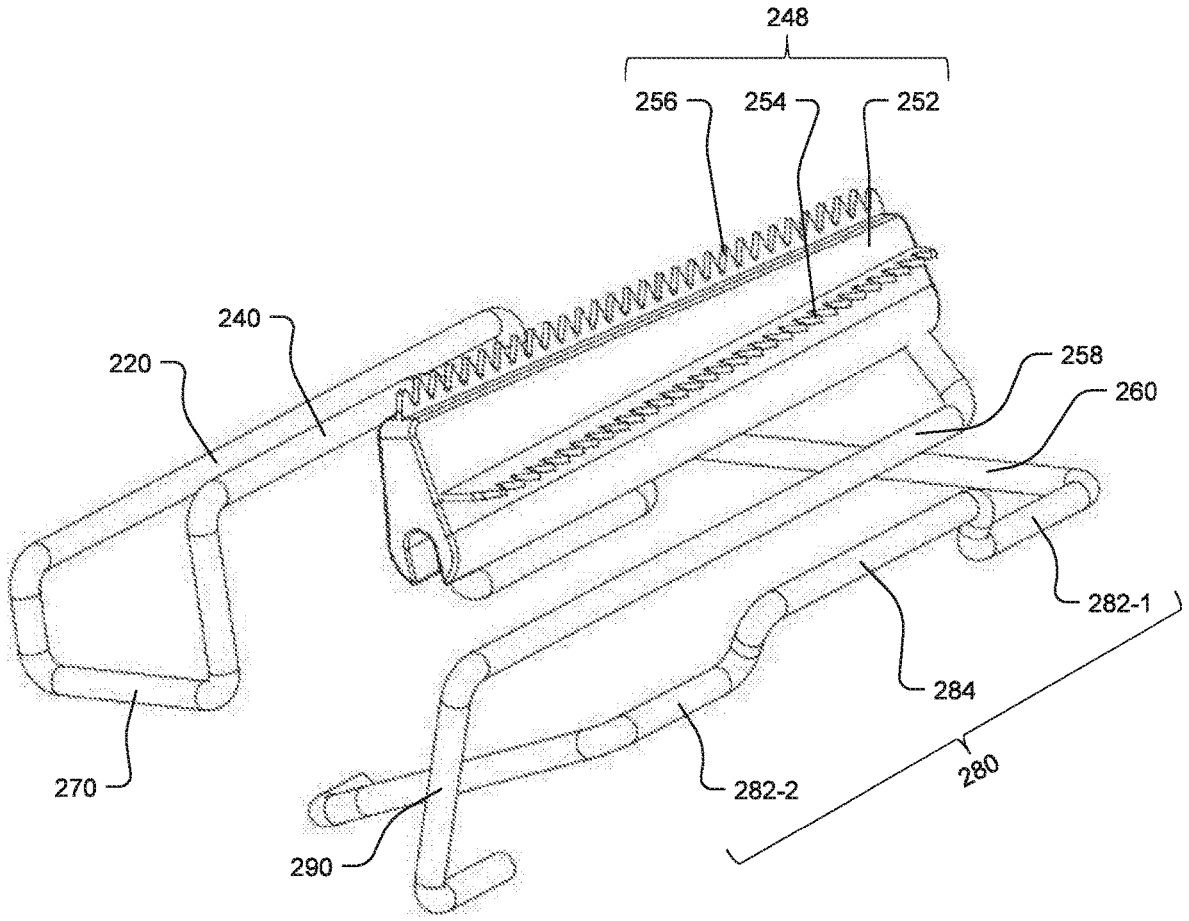

In an embodiment, fourth portion 280 can have a stepped shape consisting of two lower ends such as 282-1 and 282-2 and a raised middle section 284—three of them constituting the fourth portion 280—as shown in FIG. 1D. In application the two lower ends 282 rest on outer circumference i.e. top surface of reeled product and the raised middle section 284 provides a raised area for holding free end of the reeled product in first mode of use as would be explained in subsequent figures.

FIG. 1C illustrates details of base portion 300 of the reeled product dispenser 100 wherein the base portion 300 consists of a first bottom curved wire portion 310 and a second bottom curved wire portion 320, the two bottom curved wire portion connected to each other; and a first major flanking portion 330. The second bottom curve wire portion 320 passes underneath the roll, crossing the breadth of the inner circumference of the roll and curves in a circular fashion to form the first major flanking portion 330 which takes a vertical slanting orientation as shown in the exemplary illustration, and joins with fourth portion 280 of top portion 200. In an aspect, one purpose of these curved potions (they are shown as a part of a circle here but can have a different profiles depending on thickness of the tape i.e. when the tape thickness is high, a different area of this curved portion is in contact with the inner surface of the reel, and this changes as the tape diameter reduces. This allows the clip to be held evenly on the tape at all thickness.

FIGS. 1C and 1D further show cutting means 248 consisting of a horizontally disposed first cutting edge 254 and a vertically disposed second cutting edge 256 held on a holder 252 to form cutting means 248. The holder 252 can be detachably fixed to first portion of top portion 200. In another aspect, the second cutting edge 256 need not be placed on a holder, wherein, for instance, a holder may be required only in cases where the tape is thick. In another exemplary aspect, a single blade may also only be incorporated (instead of the two blades) and therefore the configuration shown in FIGS. 1C and 1D are only exemplary in nature and any other configuration with one or more blades/cutting portions is completely within the scope of the present invention.

In an aspect, first major flanking portion 330 gets disposed on one side of the reeled product, and top portion 200 includes a second major flanking portion 260 that gets disposed on the other side of the reeled product so that the dispenser is secured with the reeled product without any chance of slipping out. The second major flanking portion 260 extends from fourth portion 280 to second portion 220 of the top portion 200 as shown in FIGS. 1A to 1C.

In an aspect, top portion 200 further includes a minor flanking portion 270 on same side as first major flanking portion 330, and it is disposed between and connected to second portion 220 and third portion 240.

In an aspect, top portion 200 further incorporates an inclined portion 290 extending vertically down from a fifth portion 258 on the same side as first major flanking portion 330 as shown in FIG. 1D. The fifth portion 258 may be an extension of the first portion 250 disposed parallel to the first portion 250 and in between the first portion 250 and the fourth portion 280.

In an embodiment, the base portion 300 further consists of a slightly hooked portion towards its loose end. The hooked end portion is designed to attach itself to the inner circumference of the reeled product 400 and provide an anchor like support to the dispenser 100. In terms of its construction and placement on the reeled product 400, the base portion is designed to hold the dispenser 100 strongly with the bottom of the reeled product 400 with uniform force, irrespective of the reeled product 400 size and thickness.

In an aspect, the top portion 200 and the base portion 300 are made of a single wire as is evident from the exemplary illustrations of FIGS. 1A to 1D. In an aspect, material of the wire can have spring like properties to provide a force for the top portion 200 and the base portion 300 to remain biased towards each other after they are pulled away from each other for attachment to a reeled product as would be explained in succeeding figures. In an aspect, the biasing force provides a continuing contact of the top portion with outer circumference of the reeled product after the dispenser has been attached to a reeled product for use and thickness of roll of the reeled product gets diminished with usage.

Figure 2A:
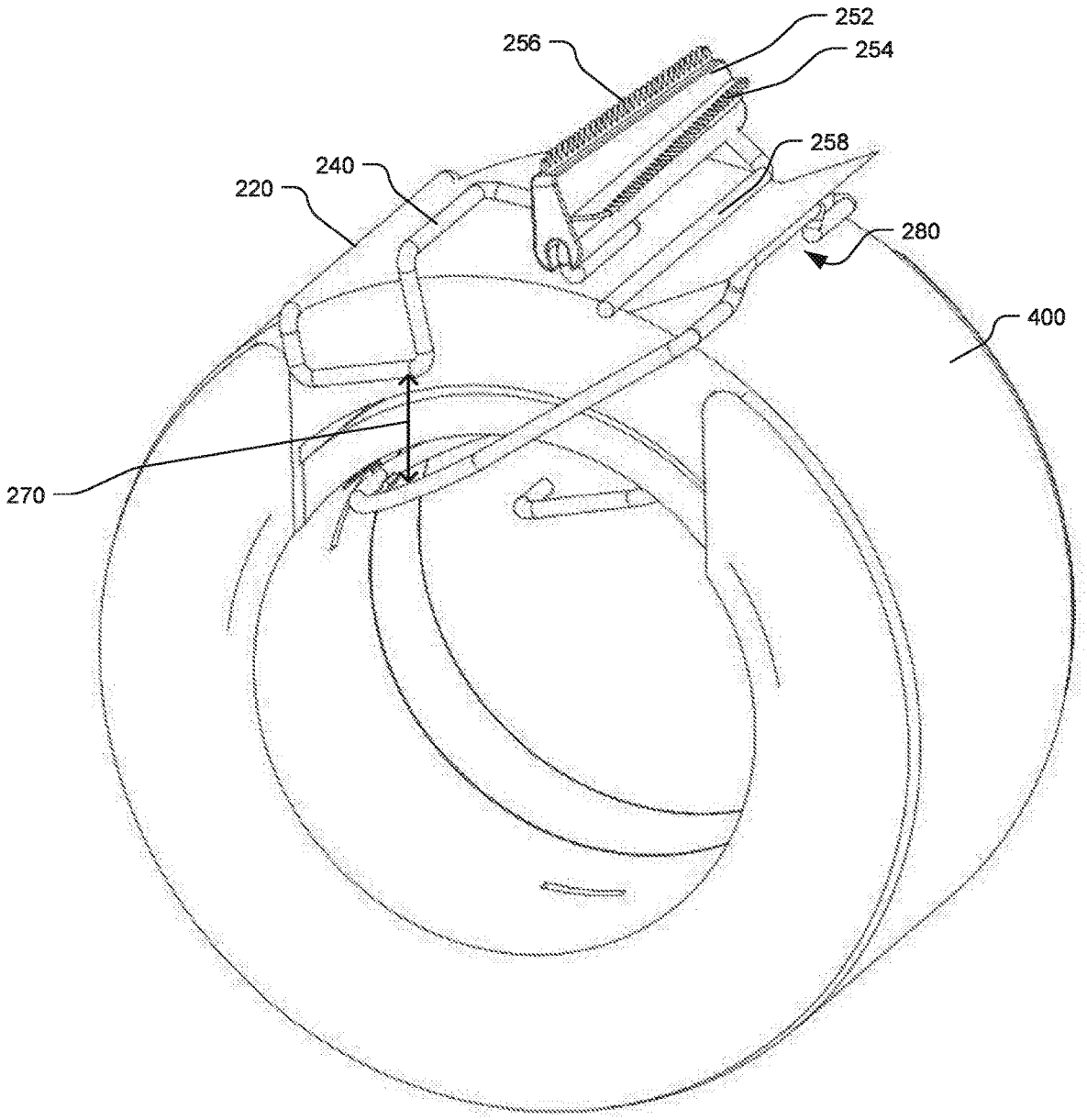
FIGS. 2A to 2C illustrate exemplary representation of the disclosed reeled product dispenser operatively coupled to a reeled product in accordance with embodiments of the present disclosure.
Figure 2B:
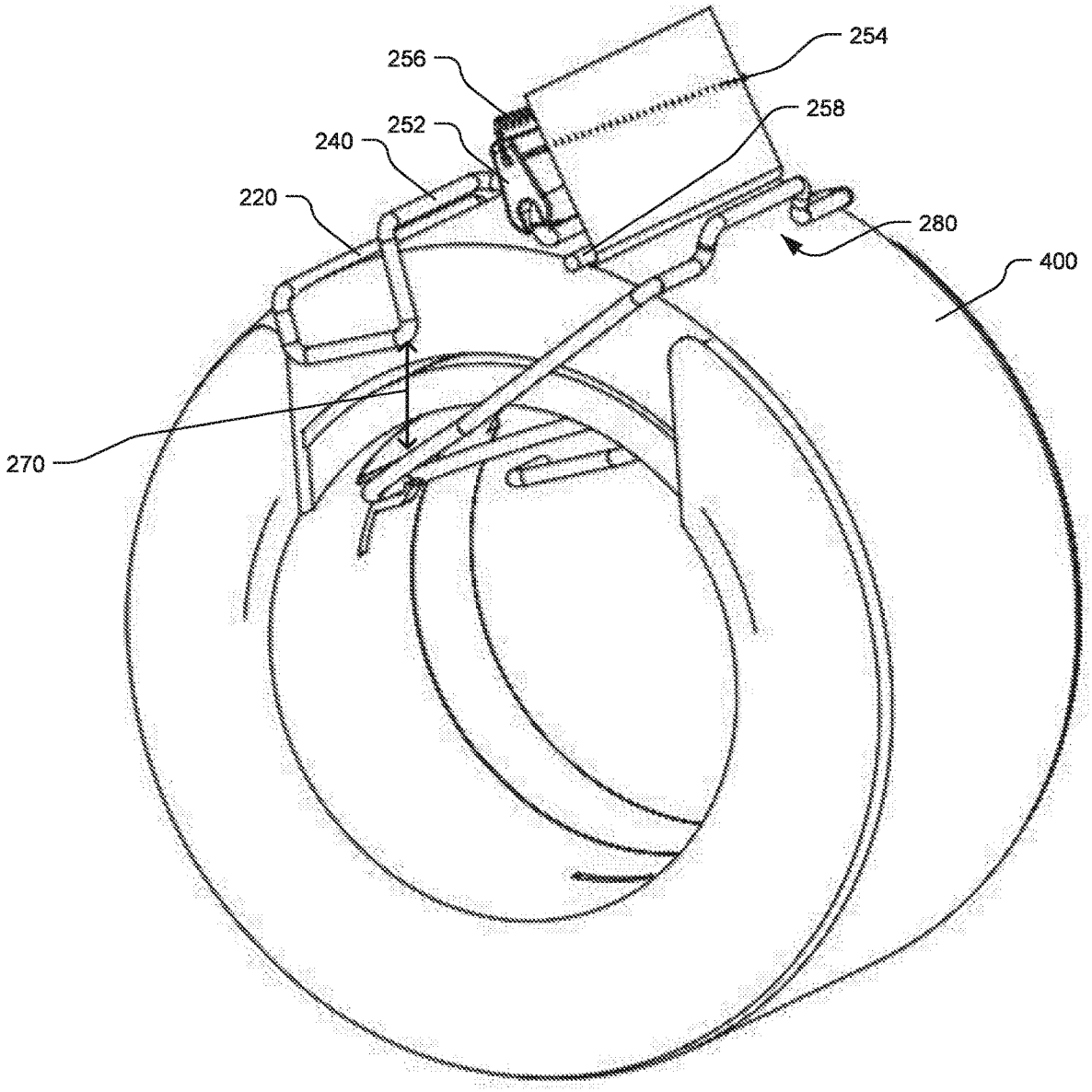
Figure 2C:
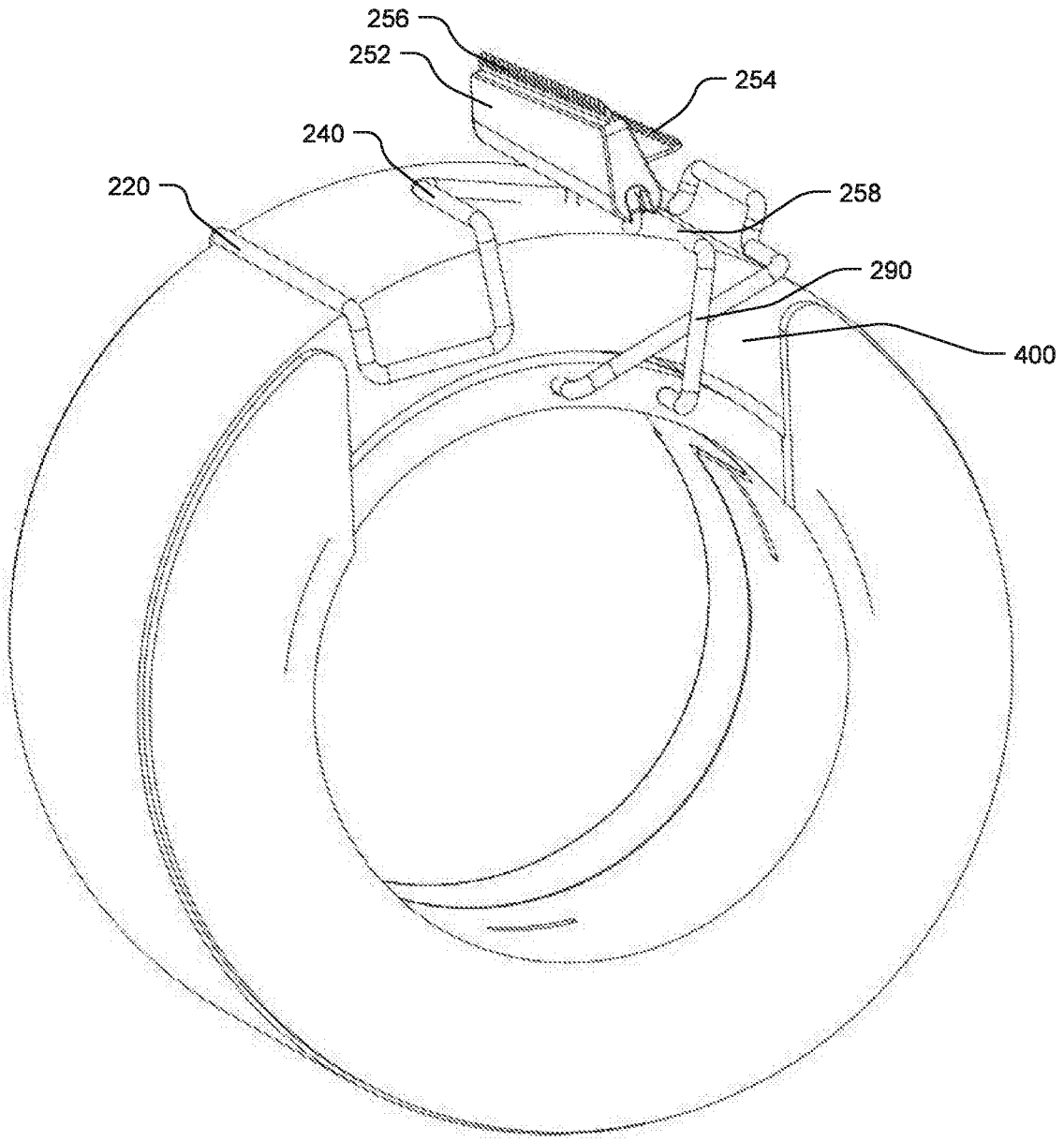

FIGS. 2A, 2B and 2C illustrate exemplary representations of a reeled product dispenser 100 operatively coupled to a reeled product 400 wherein the reeled product dispenser 100 is placed onto the reeled product 400 such that the base portion 300 of the reeled product dispenser 100 is attached to the inner circumference of the reeled product 400 and top portion 200 is positioned above and over the outer circumference of the reeled product 400. The biasing force between the top portion 200 and the base portion 300 is sufficient enough to hold the dispenser 100 with the reeled product. Under this condition of attachment of the dispenser 100 with a reeled product 400, gap between the top portion 200 and the base portion as exemplified by dimension 270 shall diminish as the top portion 200 moves towards the base portion 300 under biasing force as thickness of roll of the reeled product reduces after some use.

FIG. 2B illustrates an application of the disclosed dispenser in a first configuration (or a first mode of dispensing) wherein the reeled product dispensed is cut from top face side of the reeled product. For example, if the reeled product is a tape with adhesive on one side, in the first configuration, the tape is cut from the side that does not have adhesive. In the first mode or configuration of application, free end of the reeled product 400 is identified and the dispenser 100 is slided through the reeled product 400 till the dispenser 100 reaches the area near the free end. The free end is then pulled through passing under the second portion 220 and raised third portion 240 and passed over the first portion 250 to finally rest the free end on the raised fourth portion 280. On each occasion when the tape is used, the free end is lifted from the raised fourth portion 280 and pulled for a desired length. The free end is finally cut using the horizontally disposed first cutting edge 254 of the first portion 250. As the reeled product 400 is used, the dispenser 100 is slided in a direction opposite of the tape movement.

It is to be appreciated that ability to configure dispensing of an adhesive tape in manner that it gets cut from non-adhesive side provides an advantage during dispensing of the tape around an object as no separate manual effort to hold the cut end and thereafter pasting/sticking it to surface of the object would be required as the tape can be cut close to the surface of the object.

Figure 3A:
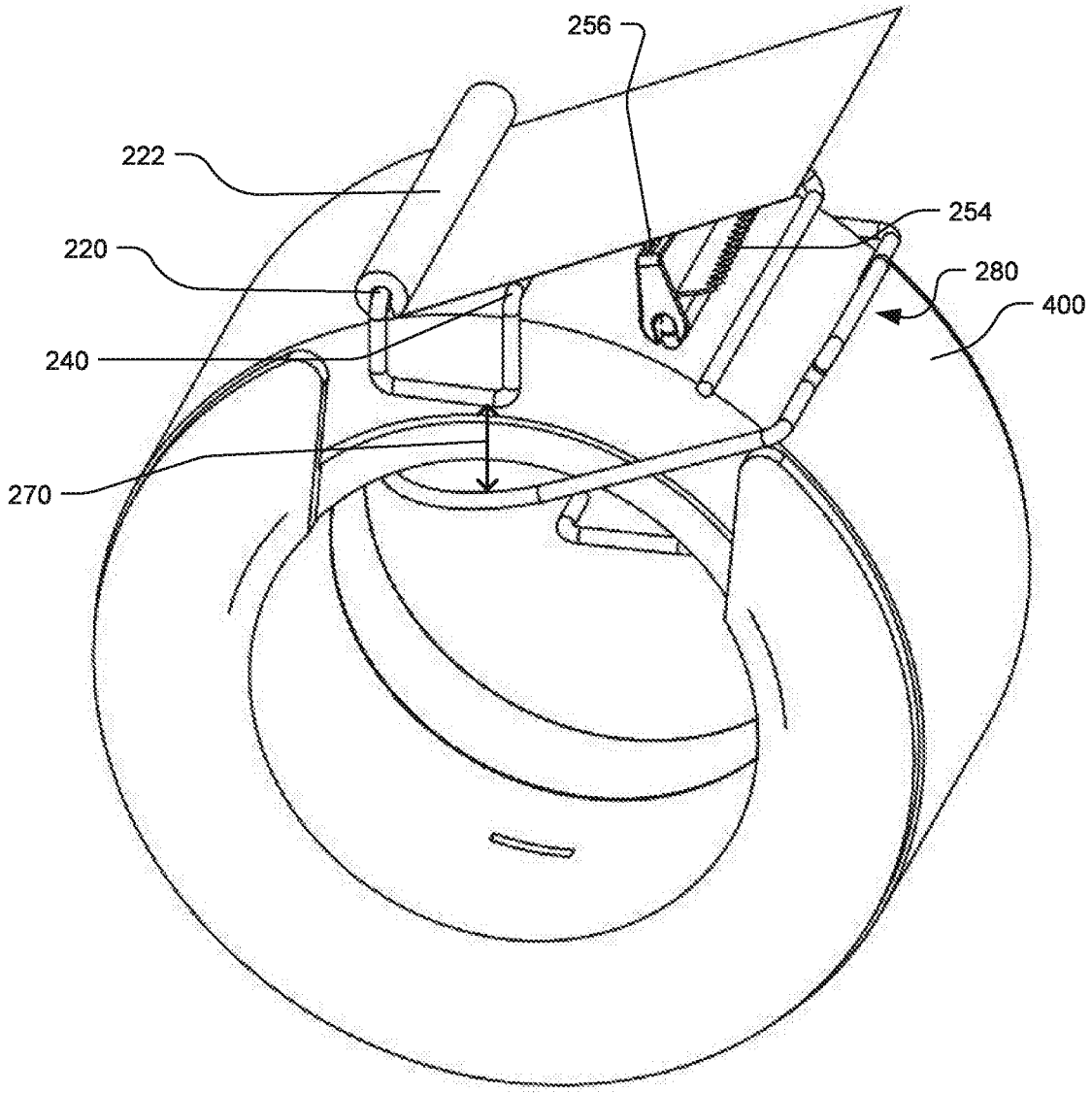
FIG. 3A illustrates an exemplary representation of second configuration of application of the disclosed reeled product dispenser coupled to a reeled product in accordance with embodiments of the present disclosure.

FIG. 3A illustrates an application of the disclosed dispenser 100 in a second configuration (or second mode of application) wherein the reeled product dispensed is cut from bottom face side of the reeled product. For example, if the reeled product is a tape with adhesive on one side, in the second configuration of use, the tape is cut from the adhesive bearing side. In this configuration/mode of application, free end of the reeled product 400 is identified and the dispenser 100 is slided through the reeled product 400 till the dispenser 100 reaches the area near the free end. The free end is then pulled through passing under the second portion 220 and passed over the raised third portion 240 to finally rest the free end on horizontally oriented second cutting edge 256 of the first portion 250. On each occasion when the tape has is used, the free end is lifted from the second cutting edge 256 of the first portion 250 and pulled for a desired length. The free end is finally cut using the second cutting edge 256. As the reeled product 400 is used, the dispenser 100 is slided in a direction opposite of the tape movement.

Thus, the disclosed dispenser provides advantage of dispensing a reeled product such as an adhesive tape, in either mode of cutting it from non-adhesive side or from the adhesive side.

Also shown in FIG. 3A is a roller 222 disposed over the second portion 220 to enable free passing and smooth sliding of the reeled product through top portion 200 as the reeled product is pulled for dispensing. It is to be appreciated that roller 222 is effective in free passing and smooth sliding of the reeled product in both the first mode and the second mode of dispensing the reeled product.

Figure 3C:
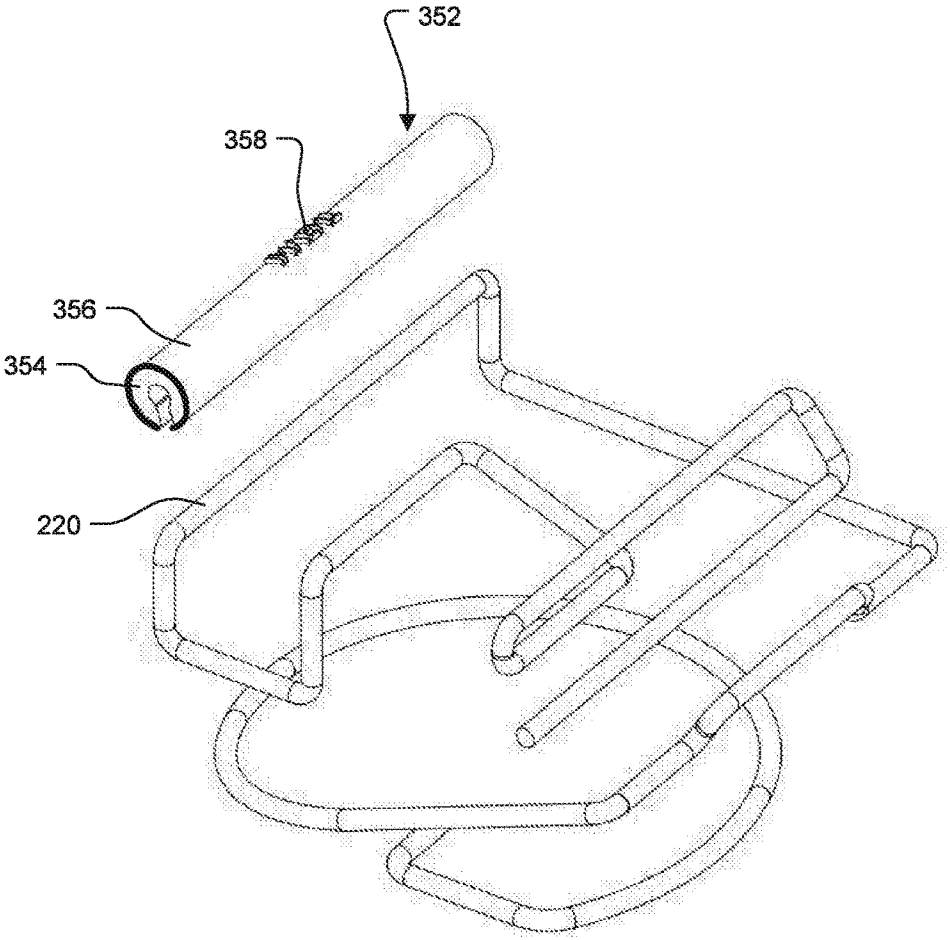
FIG. 3C illustrates an exemplary exploded view showing construction and installation of self-inking roller in accordance with embodiments of the present disclosure
Figure 3B:
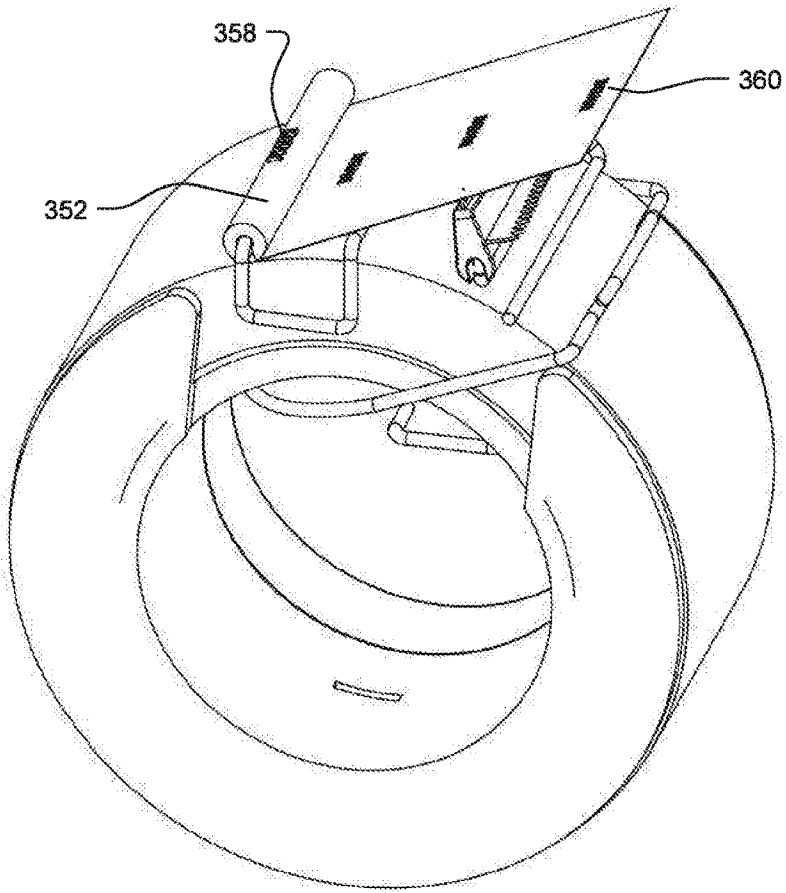
FIG. 3B illustrates an exemplary representation showing functioning of a self-inking roller to brand the dispensed reeled product in accordance with embodiments of the present disclosure.

In an embodiment, roller disposed over the second portion 220 can be a self-inking roller to additionally brand the dispensed reeled product as it is being dispensed as shown in FIG. 3B. Self-inking roller 352 can incorporate embossing 358 that can get transferred to the reeled product as shown by 360 by self-inking action as the reeled product passes under the self-inking roller 352. Thus any desired branding 360 can be done with regular spacing. The spacing can be changed by changing diameter of the self-inking roller 352.

FIG. 3C illustrates an exemplary exploded view showing construction and installation of self-inking roller 353 in accordance with embodiments of the present disclosure Self-inking roller 352 comprises hollow inner plastic core 354 and cylindrical self-inking cell 356. Self-inking roller 352 can be concentrically attached with second portion 220 and can be free to rotate on the second portion 220. A logo, a tag line or a symbol can be provided as a protrusion/embossing 358 on outer surface of the self-inking roller 352 to make an impression on top surface of the dispensed reeled product. The second portion 220 provides a downward force holding the reeled product in a tight position and facilitates roller to remain in contact with reeled product. As the reeled product is pulled from roll, self-inking roller 352 also rotates and it's embossed portion 358 can make a mark on film 1304. In an embodiment, the self-inking roller 352 can be detachable fixed to the second portion 220 so that user can change it as per his requirements or for refilling/recharging of ink.

It is to be appreciated that, though the exemplary embodiment depicted in FIG. 3B illustrates self-inking action in second mode/configuration of dispensing the reeled product, it is possible to carry out self-inking in both the configurations without any limitations. It should be appreciated that the self-inking roller can be on the first raised portion as well or configured with any other suitable element of the proposed dispenser that enables the desired self-inking and roller functionality.

Figure 4B:
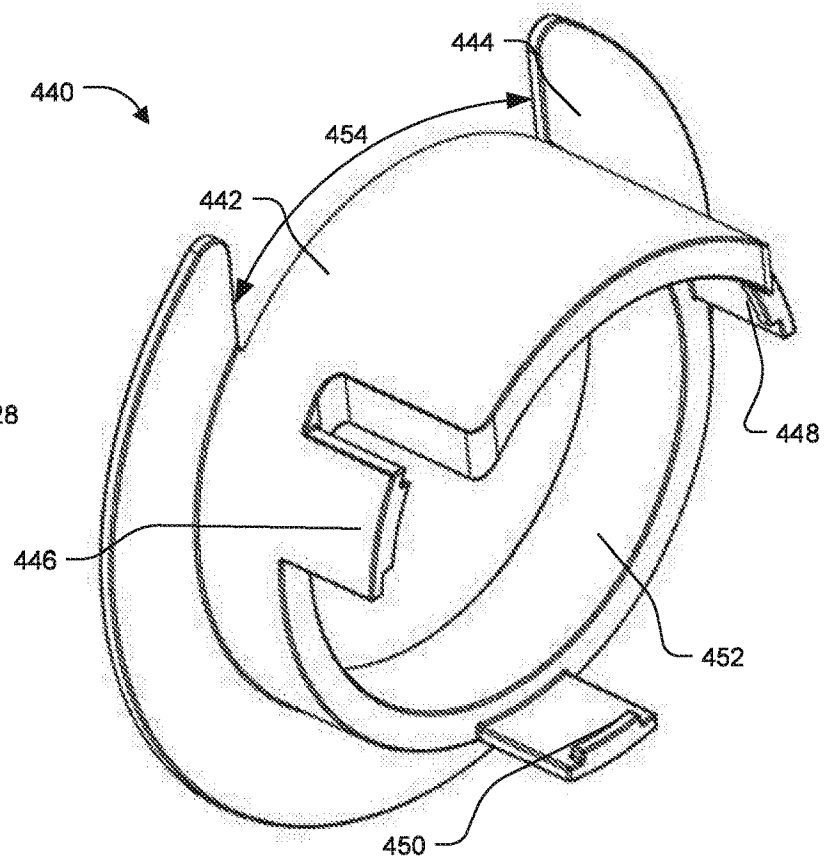
FIGS. 4A, 4B and 4C illustrate exemplary representation of the disclosed reeled product coupled with a roll of reeled product held in a cassette in accordance with embodiments of the present disclosure.
Figure 4A:
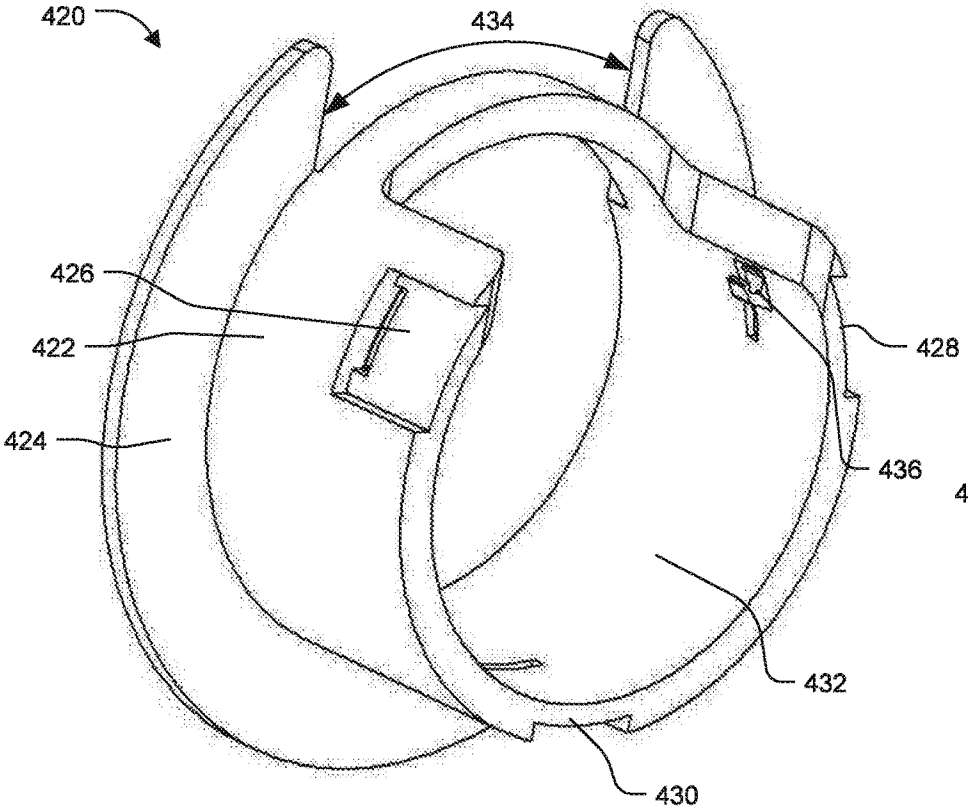
Figure 4C:
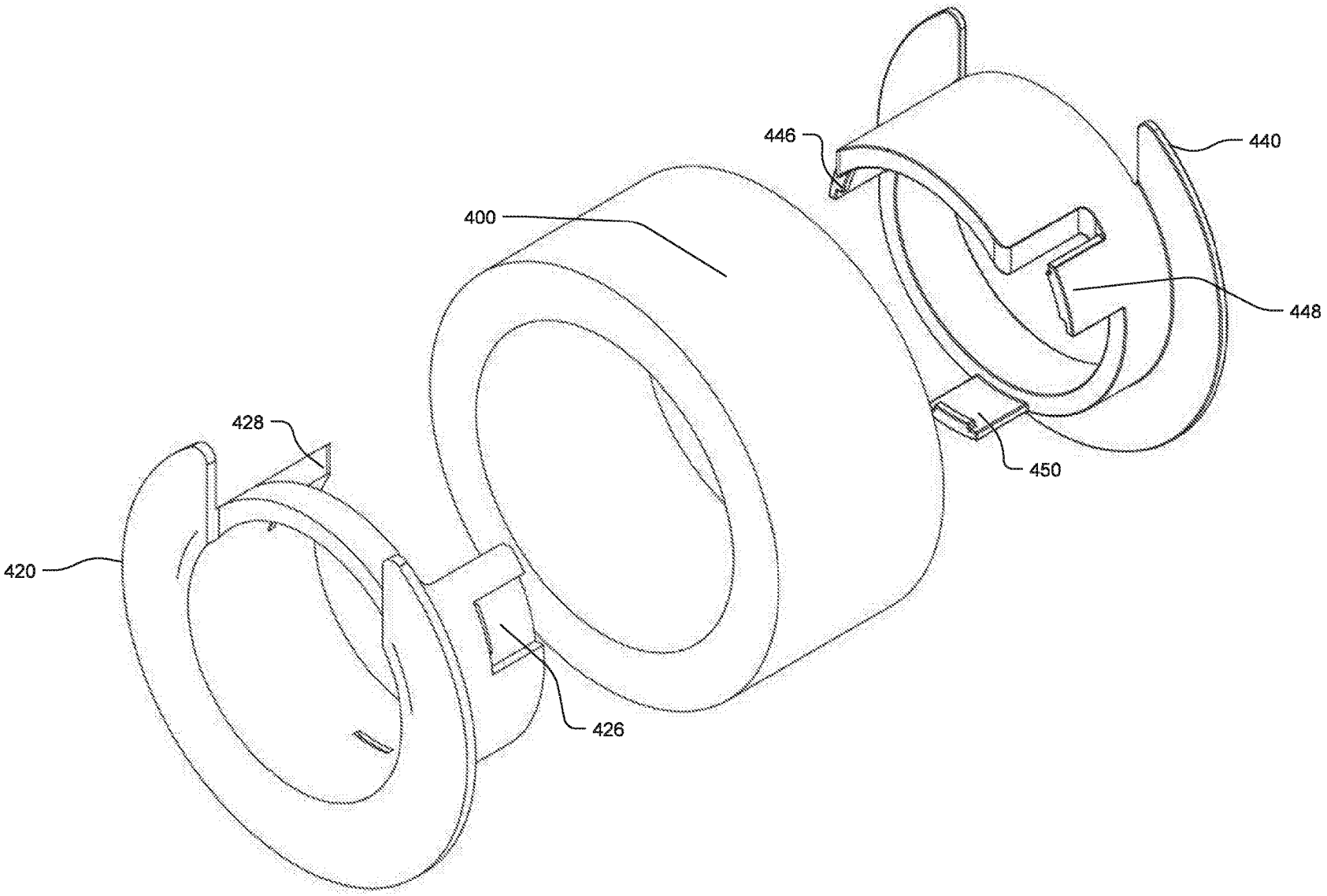

In an embodiment, the dispenser can be operatively coupled with cassette holding a roll of a reeled product. The cassette can have a first side cover 420 and a second side cover 440 that hold the reeled product through the inner circumference of the reeled product. FIGS. 4A to 4C illustrate exemplary views of the first side cover 420, a second side cover 440 and the two side covers being fitted on two sides of a reeled product 400. The first side cover 420 (as shown in FIG. 4A) and the second side cover 440 (as shown in FIG. 4B) can be operatively coupled to the reeled product 400 to provide side support to the reeled product 400 and to hold the reeled product 400 through the inner circumference of the reeled product 400.

In an embodiment, the first side cover 420 and the second side cover 440 can be inserted from opposite sides of the reeled product 400 and engage with each other to hold the reeled product 400 between them. Further, the first side cover 420 and the second side cover 440 engage with each other through a set of at least three equispaced pairs of snap grooves 426/428/430 and snaps 446/448/450 on the first side cover 420 and the second side cover 440 respectively.

In an embodiment, the first side cover 420 and the second side cover 440 incorporate cylindrical portions 422/442 that together form a cylindrical surface for the inner circumference of the reeled product 400 to rest on. In an embodiment, the reeled product 400 is free to rotate relative to the first side cover 420 and the second side cover 440 after the first side cover 420 and the second side cover 440 have been attached to the reeled product 400.

In an embodiment, the first side cover 420 incorporates a right side flange 424 and the second side cover 440 incorporates a left side flange 444 to cover sides of the reeled product 400 after the first side cover 420 and the second side cover 440 have been attach to the inner circumference of the reeled product 400. Further, the right side flange 424 and the left side flange 444 incorporate top side cut outs 434 and 454 respectively in matching positions to allow operative coupling of the dispenser with the reeled product held between the first side cover and the second side cover.

In an embodiment, FIG. 4C shows process of assembly of the first side cover 420, the reeled product 400 and the second side cover 440 wherein snap 446/448/450 of the second side cover 440 gets inserted into the snap groove 426/428/430 of the first side cover 420 to hold the two side covers 420/440 together with the reeled product 400 positioned between right side flange 424 and left side flange 444, and resting on cylindrical surface but free to rotate with reference to the cassette formed of the two side covers 420/440.

In an embodiment of application, the disclosed dispenser 100 can be attached to the above assembly of the reeled product 400 within the first side cover 420 and the second side cover 440 in top side cutout portions 434/454 of the flanges 424/444 by firstly pulling apart the top portion 200 and the base portion 300 of the dispenser 100 and thereafter longitudinally sliding the dispenser 100 over the reeled product and cassette assembly such that the base portion 300 of the dispenser 100 engages with inner circumference of the first side cover 420 and the second side cover 440. After this the pulled apart portions can be released on which the top portion 200 can rest on outer circumference of the reeled product with the first major flanking portion 330 and the second major flanking portion 260 positioned along opposite sides of the reeled product 400. The inner circumference of the first side cover 420 and the second side cover 440 can incorporate means such as wire holding means 436 to firmly hold base portion 300 of the dispenser 100 in position.

The dispenser 100 can likewise be detached from the reeled product by first pulling apart the top portion 200 from the outer circumference of the reeled product 400 till the second flanking portion is clear of the corresponding side of the reeled product 400. Thereafter the dispenser 100 can be moved longitudinally out towards the side of first major flanking portion 330.

It is to be appreciated that it is possible to attach the disclosed dispenser 100 to a reeled product directly without the reeled product being held within cassette made of the first side cover 420 and the second side cover 440, in which case base portion 300 gets engaged directly with the inner circumference of the reeled product.

In an aspect, the dispenser can be operatively coupled with any or both of a first side cover and a second side cover, wherein the first side cover and the second side cover hold the reeled product through the inner circumference of the reeled product, and wherein the first side cover and the second side cover are inserted from opposite sides of the reeled product and engage with each other to hold the reeled product between them. In an aspect, the first side cover and the second side cover engage with each other through a set of at least three equi-spaced pairs of snap grooves and snaps or by means of screws on the first side cover and the second side cover respectively. In another aspect, the first side cover incorporates a right side flange and the second side cover incorporates a left side flange to cover sides of the reeled product after the first side cover and the second side cover have been attach to the inner circumference of the reeled product. In another aspect, both the right side flange and the left side flange have top side cut out in matching positions to allow operative coupling of the dispenser with the reeled product held between the first side cover and the second side cover. In yet another aspect, the inner circumference of the first side cover and the second side cover incorporate means to engage with at least a part of the base portion to provide a firm anchoring to the base portion.

Figure 5A:
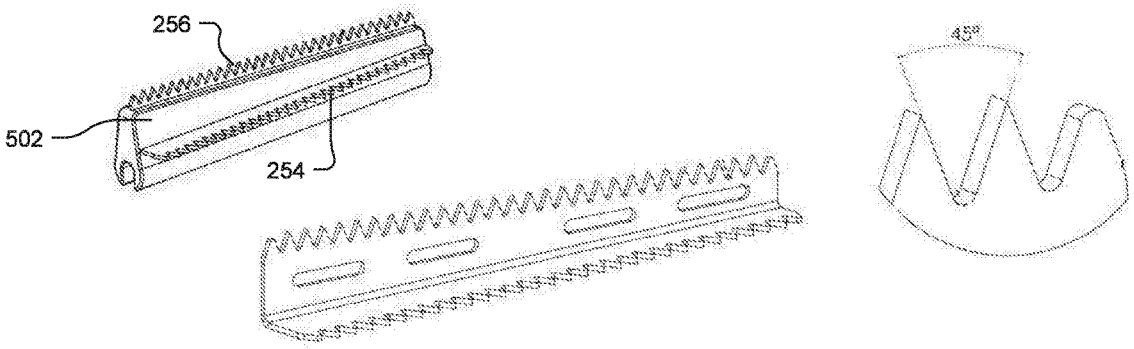
FIGS. 5A to 5E illustrate exemplary representation of different embodiments of cutting means.
Figure 5B:
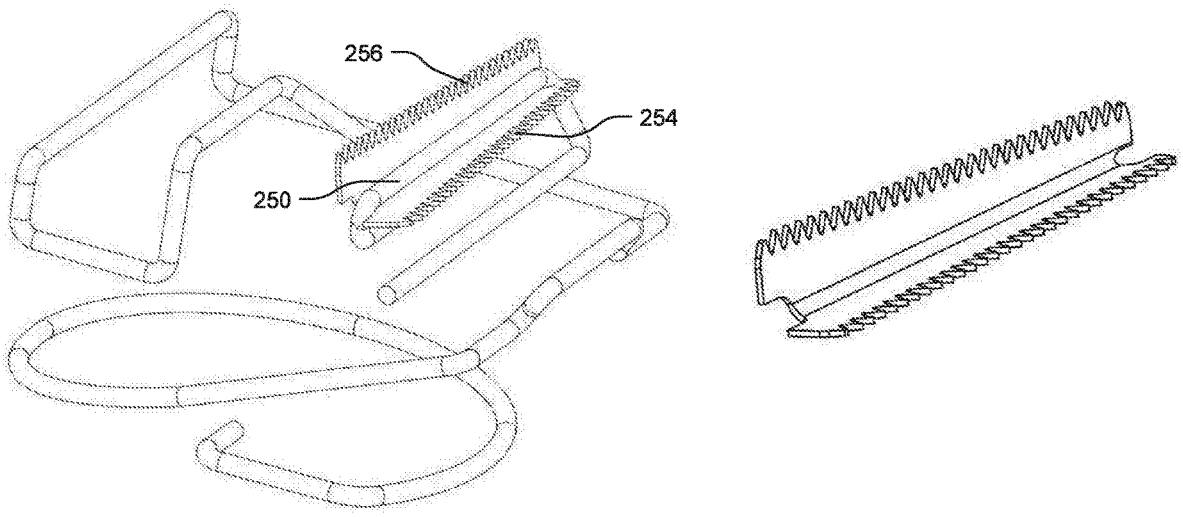

FIGS. 5A, 5B, 5C, 5D, and 5E illustrate exemplary representations of different embodiments of cutting means 248 coupled with the first portion 250 of the top portion 200, wherein in an exemplary representation as shown in FIG. 5A, first cutting edge 254 and second cutting edge 256 can be formed of a V shaped blade. The first cutting edge 254 and second cutting edge 256 can incorporate V shaped teeth to provide pointed cutting points on the respective cutting edges. The V shaped blade can be held in a blade holder 502 detachably coupled to first portion 250 of top portion 200 of the dispenser 100. In an embodiment, the first cutting edge 254 and second cutting edge 256 can be tapered in their respective planes in relation with axis of the reeled product to provide a gradual cutting action. In an alternate embodiment, the V shaped blade having the first cutting edge 254 and a second cutting edge 256 can be directly mounted on the first portion 250 as shown in FIG. 5B.

Figure 5C:
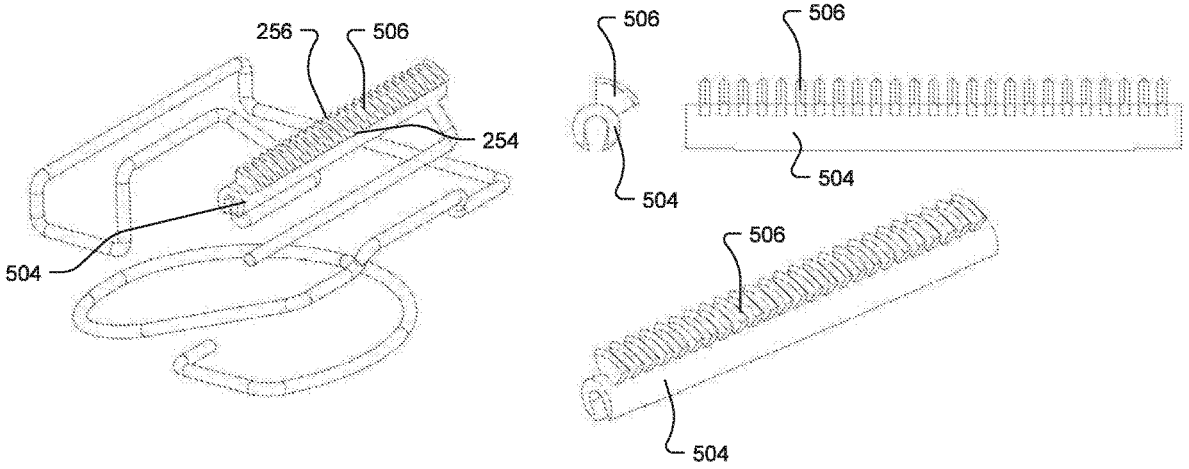

In an alternate embodiment as shown in FIG. 5C, first cutting edge 254 and second cutting edge 256 can be formed of a plurality of quadrant-shaped projections 506 fixed parallel to each other on a holder 504, wherein corners between the horizontal sides and circular sides of the plurality of quadrant-shaped projections form the first cutting edge 254, and corners between the vertical sides and the circular sides of the plurality of quadrant-shaped projections form the second cutting edge 256.

Figure 5D:
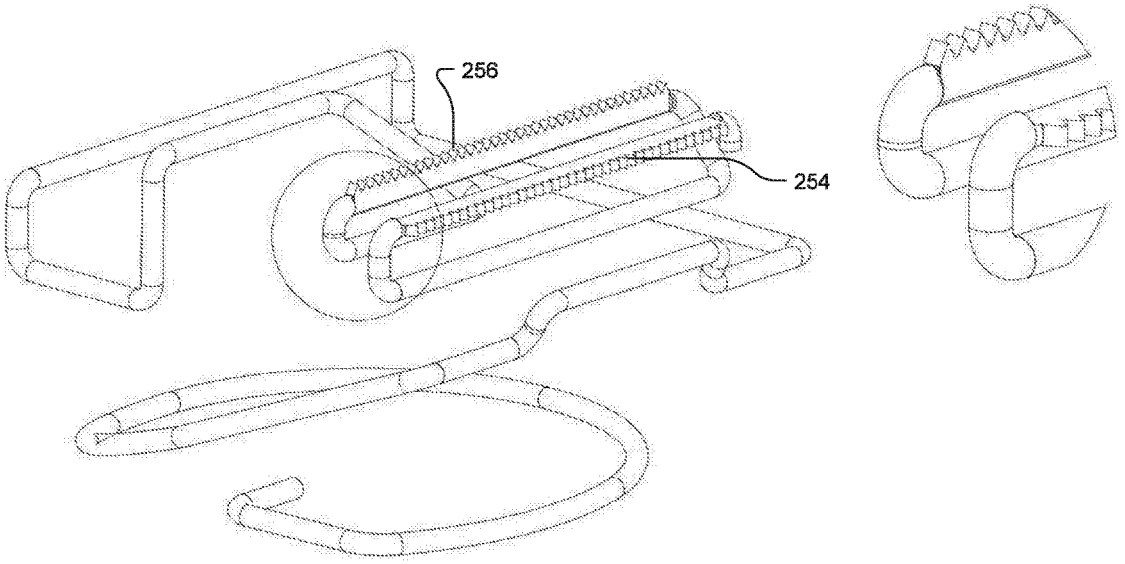

In another alternate embodiment, as shown in FIG. 5D, first portion 250 can incorporate two parallel horizontally disposed portions that incorporate vertically oriented V shaped teeth and horizontally oriented V shaped teeth respectively to provide the first cutting edge 254 and the second cutting edge 256.

Figure 5E:
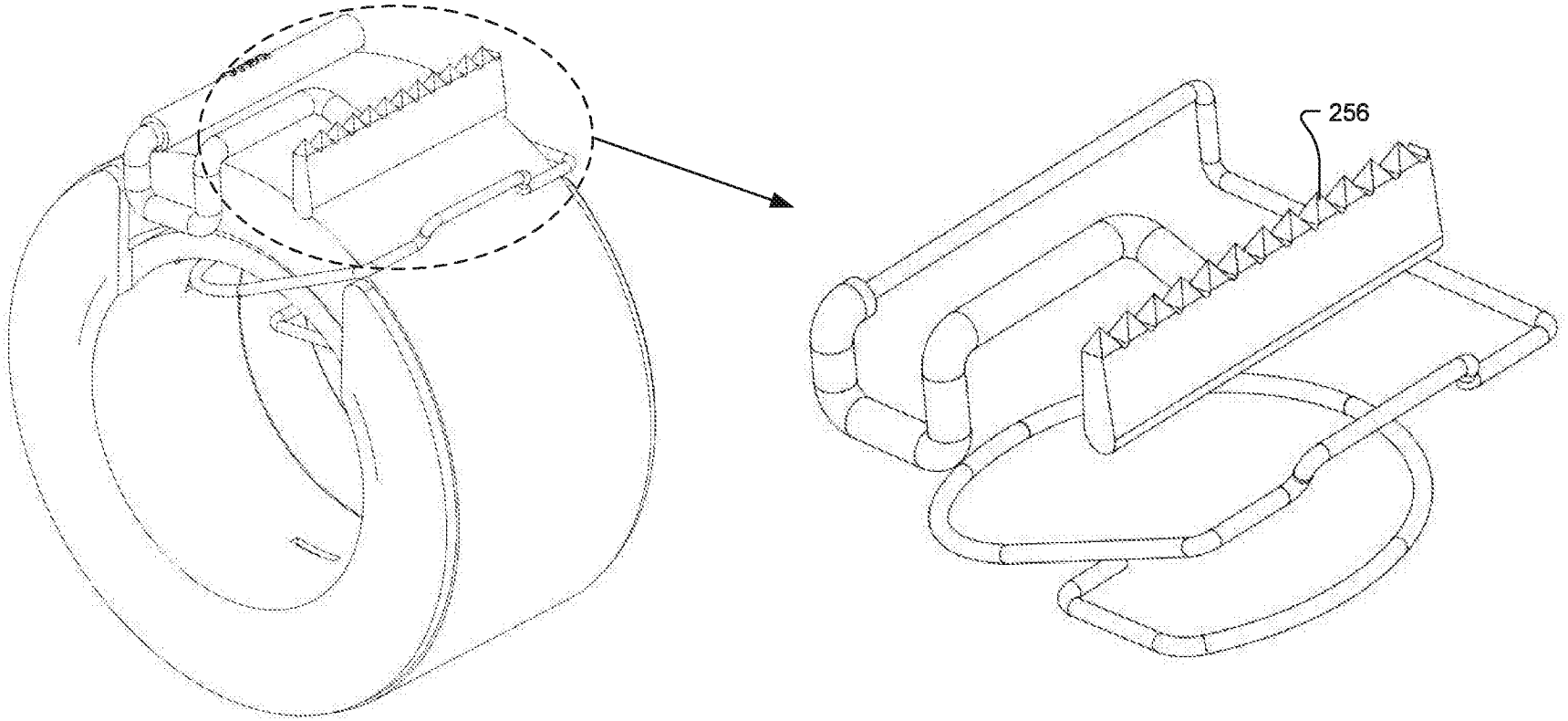

FIG. 5E illustrates another exemplary representation of the proposed tape dispenser where the first portion 250 itself is integrated with a single/vertically oriented cutting edge 256. In an exemplary aspect, said cutting edge 256 or any part thereof can be made of plastic, metal or any combination of such materials, and therefore all such variations are well within the scope of the present invention.

In sum therefore, the first portion 250 may be integrated with a vertical and/or horizontal cutting edge(s) or can be operatively/detachably coupled thereto, wherein the orientation, size, dimension are completely non-limiting embodiments and depend on the desired/intended use of the proposed dispenser.

In another exemplary embodiment, the proposed wire structure being used to made the dispenser can be made of two materials (say plastic and metal wire), wherein the top side raised portion with blade holder and the blade can be made of plastic, and the remaining wire structure can be made from metal wire so as to reduce weight and give aesthetic look.

Figure 6A:
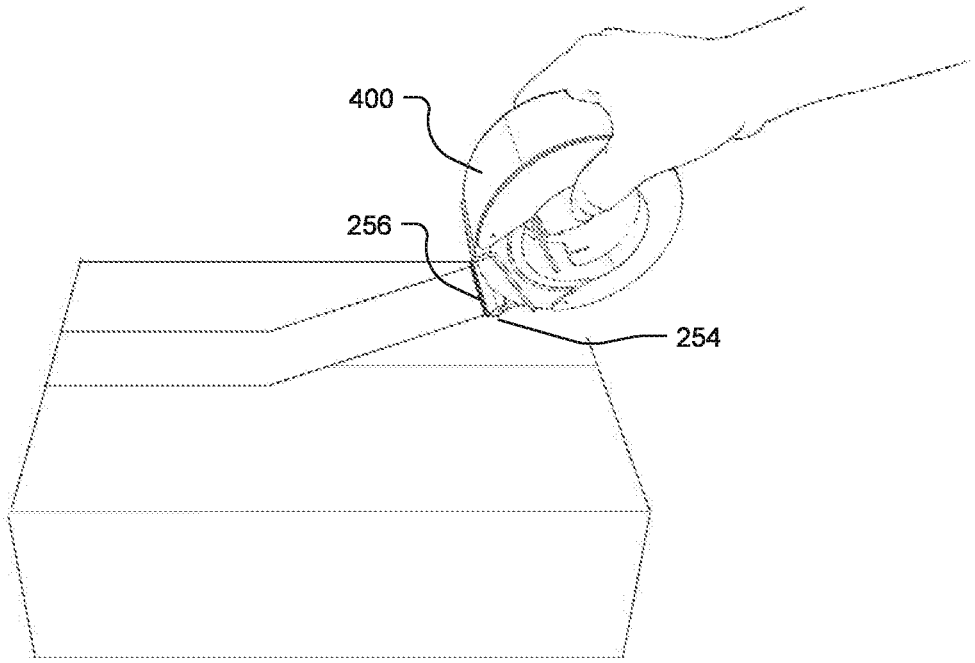
FIGS. 6A to 6C illustrate exemplary representation of method of application of the reeled product dispenser in accordance with embodiments of the present disclosure.
Figure 6B:
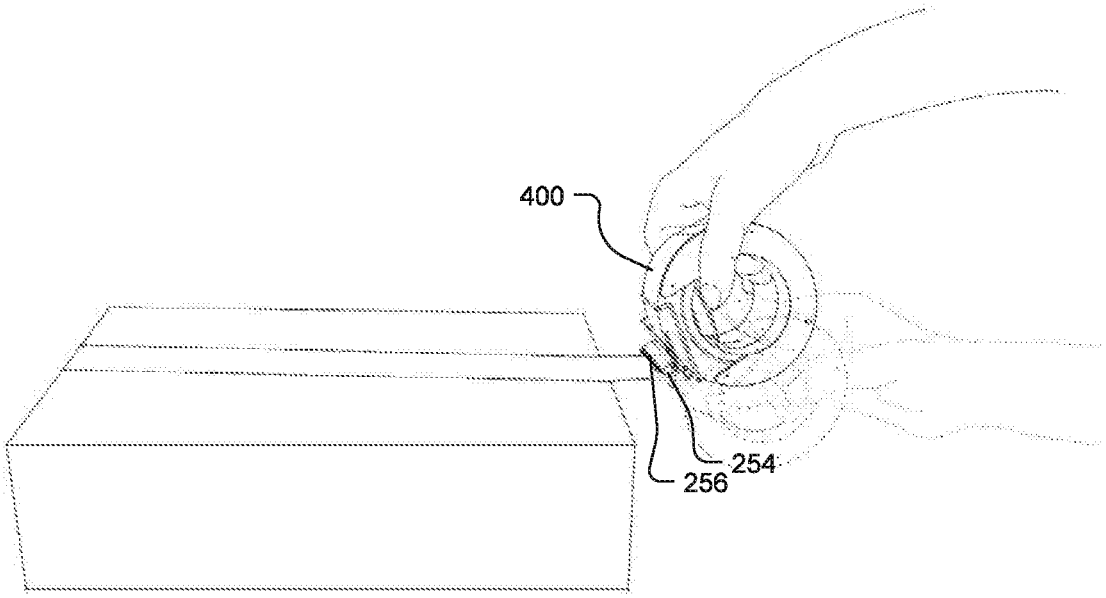
Figure 6C:
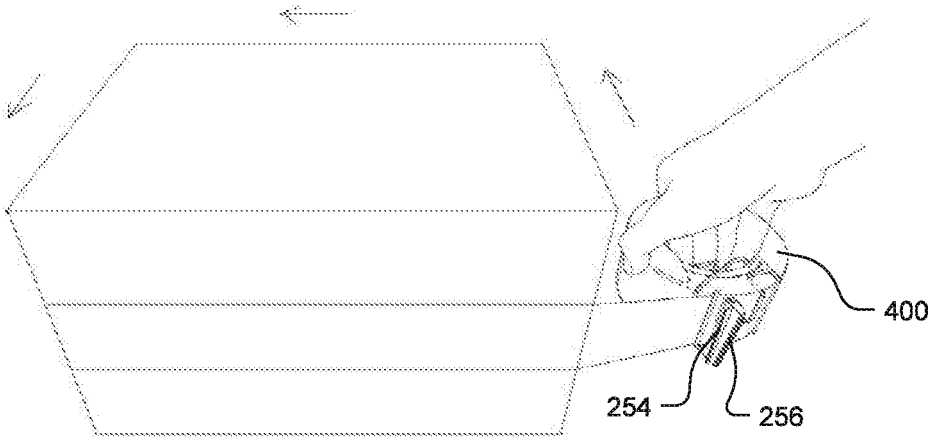

FIGS. 6A to 6C illustrate exemplary representations of method of application of a reeled product such as a tape using the disclosed dispenser 100 to surface of a large object. Free end of the reeled product 400 can be pulled out and applied to the surface, and thereafter, cassette that holds the reeled product 400 can be pulled in direction of application of the tape. When required length of tape has been applied to the surface, the cassette holding the tape can be maneuvered in such a way that the tape touches a cutting edge such as first cutting edge 254 as shown in FIGS. 6A to 6C, or second cutting edge 256 (as the case may be depending on mode of application) of the dispenser 100. The cutting edge can then be used to cut the tape by application of force in required direction, and cut free end of the reeled product 400 can be rested at corresponding point.

It is to be appreciated that while applying an adhesive tape under such application it is advantageous to be able to cut the tape from non-adhesive side i.e. top side. This is because in that case the tape shall not be disposed between the tape and the object resulting in ability to cut the tape even as tape is close to the surface (or may be already pasted to the surface) of the object. This saves on manual operation of holding the tape and pasting/sticking it to the surface, thereby improving efficiency of dispensing.

It is further to be appreciated that using the disclosed dispenser 100, it is possible to rewind excess length of reeled product back to roll of the reeled product. This can be done by simply rotating the roll in opposite direction, and the dispensed reeled product gets rolled back in position because of properly located dispenser in relation with the roll which is facilitated by proper side flanking on both sides.

Thus, the present disclosure provides a reeled product dispenser that enables dispensing of the reeled product in two different modes that facilitate cutting of the reeled product from top side or bottom side depending on requirement, thereby improving efficiency of dispensing the reeled product.

In an aspect, tape cutting blade can be made as an integral part of wire structure, wherein vertical blade and horizontal blade can be made individually on wire by pressing and cutting. Cross section of wire may be circular such that after pressing and cutting, cross section of wire gets convert into rectangular shape. Teeth or notches can be cut on both edges by using a cutting tool. Both cutting blades can be configured to work independently, wherein the horizontal blade 254 can be used to cut tape which passes under 220, 240, and 250, whereas vertical blade 256 can be used to cut tape that passes under 220 but over 240.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

ADVANTAGES OF THE INVENTION

The present disclosure provides a portable and detachable dispenser for reeled products.

The present disclosure provides a compact, portable, and easy-to-use dispenser for reeled products.

The present disclosure provides a dispenser that is of simple construction and light weight.

The present disclosure provides a dispenser that continues to provide constant and uniform holding force to keep the dispenser on the roll even with diminishing diameter of the roll.

The present disclosure provides a stable dispenser that does not fall off the roll at any stage of use.

The present disclosure provides a dispenser that allows dispensing of reeled product in two different modes for universal application while dispensing the reeled product.

The present disclosure provides a dispenser that enables branding of dispensed reeled product by self-inking action.

The present disclosure provides a dispenser that allows dispensing of reeled product by holding the dispenser and the reeled product in hand and moving around large objects that cannot be moved.

The present disclosure provides a dispenser that allows rewinding of excess length of reeled product back to roll of the reeled product.

The present disclosure provides a dispenser having slidable movement of the reeled product during its working.

The present disclosure provides that enables easy relocation of a cut end of the reeled product.

We claim:

1. A portable and detachable dispenser to dispense a reeled product, the dispenser comprising:

a base portion configured to, at its one end, engage with inner circumference of a roll of the reeled product that is coupled to the dispenser for dispensing the reeled product; and a top portion operatively coupled with the base portion and configured to attach to outer circumference of the coupled roll of the reeled product, said top portion comprising a first portion operatively coupled to or integrated with a cutting means, a second portion and a raised third portion positioned on one side of the first portion, and a raised fourth portion positioned on the other side of the first portion, the raised third portion and the raised fourth portion being raised above the outer circumference of the coupled roll of the reeled product;

wherein the top portion and the base portion are made of a single wire; and wherein, in a first mode of use, the reeled product from the coupled roll passes under the second portion, the raised third portion, and the first portion to enable the reeled product to be cut using the cutting means of the first portion, and the free end of the reeled product rests on the raised fourth portion.

2. The dispenser of claim 1, wherein, in a second mode of use, the reeled product from the coupled roll passes under the second portion and over the raised third portion to enable the reeled product to be cut using the cutting means of the first portion, and the free end of the reeled product rests on the raised third portion.

3. The dispenser of claim 2, wherein the cutting means comprises a horizontally disposed first cutting edge and a vertically disposed second cutting edge, and wherein, in the first mode of use, the first cutting edge is used to cut the reeled product from top side of the reeled product, and in the second mode of use, the second cutting edge is used to cut the reeled product from the bottom side of the reeled product.

4. The dispenser of claim 3, wherein the horizontally disposed first cutting edge and the vertically disposed second cutting edge are configured on a V shaped blade held in a blade holder, and wherein the blade holder is configured for removable fitment on the first portion to form the cutting means.

5. The dispenser of claim 4, wherein the first cutting edge and the second cutting edge incorporate a plurality of V shaped notches.

6. The dispenser of claim 3, wherein the horizontally disposed first cutting edge and the vertically disposed second cutting edge are formed of a plurality of quadrant-shaped projections fixed parallel to each other on a holder, wherein corners between the horizontal sides and circular sides of the plurality of quadrant-shaped projections form the first cutting edge, and corners between the vertical sides and the circular sides of the plurality of quadrant-shaped projections form the second cutting edge.

7. The dispenser of claim 6, wherein the circular side of the plurality of quadrant-shaped projections are made pointed to provide sharp and pointed corners.

8. The dispenser of claim 3, wherein the first portion incorporates two parallel horizontally disposed portions, wherein the two horizontally disposed portions incorporate vertically oriented V shaped teeth and horizontally oriented V shaped teeth respectively to provide the first cutting edge and the second cutting edge.

9. The dispenser of claim 1, wherein a roller is configured on the second portion to enable free passing and sliding of the reeled product by rotation of the roller.

10. The dispenser of claim 9, wherein the roller is a self-inking roller that enables desired inking of the reeled product as the reeled product is dispensed.

11. The dispenser of claim 1, wherein the base portion comprises a first bottom curved wire portion and a second bottom curved wire portion, the first bottom curved wire portion and the second bottom curved wire portion connected to each other, and a first major flanking; wherein the first major flanking operatively couples the base portion to the top portion through the fourth portion of the top portion.

12. The dispenser of claim 1, wherein the top portion further comprises an inclined portion extending vertically down from a fifth portion on the same side as first major flanking portion, wherein the fifth portion is an extension of the first portion disposed parallel to the first portion and lies in between the first portion and the fourth portion.

13. The dispenser of claim 1, wherein the wire has spring property such that when the top portion and the base portion are moved away from each other for coupling of a roll therebetween, the wire provides a biasing force to bias the base portion and the top portion towards each other so that the base portion and the top portion remain in contact with inner circumference and outer circumference respectively of the roll even as thickness of the roll reduces with use of the reeled product.

14. The dispenser of claim 1, wherein the dispenser is operatively coupled with the roll of the reeled product in combination with a first side cover and a second side cover, wherein the first side cover and the second side cover hold the roll of the reeled product through the inner circumference of the roll.

15. The dispenser of claim 14, wherein the first side cover and the second side cover are configured for insertion from opposite sides of the roll and engage with each other to hold the roll between them.

16. The dispenser of claim 15, wherein the first side cover and the second side cover engage with each other through a set of at least three equi-spaced pairs of snap grooves and snaps on the first side cover and the second side cover respectively.

17. The dispenser of claim 14, wherein the first side cover incorporates a right side flange and the second side cover incorporates a left side flange to cover sides of the roll.

18. The dispenser of claim 17, wherein both the right side flange and the left side flange have top side cut out in matching positions to allow operative coupling of the dispenser with the roll of the reeled product held between the first side cover and the second side cover.

19. The dispenser of claim 14, wherein the inner circumference of the first side cover and the second side cover incorporate a wire holding means that engages with at least a part of the base portion to anchor the base portion.

* * * * *